US009481534B2

(12) United States Patent
Nitta et al.

(10) Patent No.: US 9,481,534 B2
(45) Date of Patent: Nov. 1, 2016

(54) CONVEYANCE DEVICE, IMAGE-FORMING DEVICE, AND MEDIUM CONVEYANCE METHOD

(71) Applicant: FUJIFILM Corporation, Tokyo (JP)

(72) Inventors: Tatsuya Nitta, Kanagawa (JP); Hiroshi Uemura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/995,501

(22) Filed: Jan. 14, 2016

(65) Prior Publication Data

US 2016/0130102 A1 May 12, 2016

Related U.S. Application Data

(63) Continuation of application No. PCT/JP2014/067626, filed on Jul. 2, 2014.

(30) Foreign Application Priority Data

Aug. 2, 2013 (JP) ..... 2013-161615

(51) Int. Cl.
*B65H 7/02* (2006.01)
*B65H 7/20* (2006.01)
(Continued)

(52) U.S. Cl.
CPC ..... *B65H 7/20* (2013.01); *B41J 13/223* (2013.01); *B65H 7/02* (2013.01); *B65H 29/041* (2013.01);
(Continued)

(58) Field of Classification Search
CPC ..... B65H 2301/4461; B65H 7/02; B65H 2515/212; B65H 2511/13
See application file for complete search history.

(56) References Cited

U.S. PATENT DOCUMENTS 8,851,662 B2 * 10/2014 Houjou ..... B41J 11/002 347/101
2005/0012265 A1 1/2005 Berlingen et al.
(Continued)

FOREIGN PATENT DOCUMENTS

JP 2005-035269 A 2/2005
JP 2008-238819 A 10/2008
(Continued)

OTHER PUBLICATIONS

International Search Report—PCT/JP2014/067626 dated Sep. 16, 2014.
(Continued)

*Primary Examiner* — Howard Sanders
(74) *Attorney, Agent, or Firm* — Studebaker & Brackett PC

(57) ABSTRACT

A conveyance device includes an image-forming drum (52) which fixes a rear surface ($P_B$) of a sheet (P) and conveys the sheet along an arc-shaped path at a transfer position (312), a chain gripper which includes a gripper (64D) which is disposed on the downstream side of the image-forming drum in a conveyance direction and holds a leading end portion of the sheet, conveys the sheet along the arc-shaped path at the transfer position, and is disposed at a position at which a portion of the path leads to the image-forming drum side from the transfer position, and a blower unit (300) which is disposed on the chain gripper side from the transfer position, blows air from the chain gripper side to the image-forming drum side on the downstream side of the transfer position in the conveyance direction, and blows air toward the sheet conveyed by the chain gripper.

14 Claims, 13 Drawing Sheets

(51) Int. Cl.
*B41J 13/22* (2006.01)
*B65H 29/04* (2006.01)

(52) U.S. Cl.
CPC ..... *B65H 2301/4461* (2013.01); *B65H 2301/44712* (2013.01); *B65H 2406/121* (2013.01); *B65H 2511/13* (2013.01); *B65H 2515/212* (2013.01); *B65H 2801/15* (2013.01); *B65H 2801/21* (2013.01)

(56) References Cited

U.S. PATENT DOCUMENTS

| | | | | |
|---|---|---|---|---|
| 2008/0229947 | A1 | 9/2008 | Detloff et al. | |
| 2010/0208021 | A1* | 8/2010 | Hori ..... | B41J 2/0057 347/102 |

FOREIGN PATENT DOCUMENTS

| | | | |
|---|---|---|---|
| JP | 2009-285877 | A | 12/2009 |
| JP | 2011-168019 | A | 9/2011 |
| JP | 2012-131065 | A | 7/2012 |

OTHER PUBLICATIONS

Written Opinion—PCT/JP2014/067626 dated Sep. 16, 2014.
International Preliminary Report on Patentability—PCT/JP2014/067626 dated Jul. 14, 2015.
An Office Action; "Notification of Reasons for Refusal" issued by the Japanese Patent Office on Jul. 19, 2016, which corresponds to Japanese Patent Application No. 2013-161615 and is related to U.S. Appl. No. 14/995,501; with English language translation.

* cited by examiner

CONVEYANCE DEVICE, IMAGE-FORMING DEVICE, AND MEDIUM CONVEYANCE METHOD

CROSS-REFERENCE TO RELATED APPLICATIONS

This application is a Continuation of PCT International Application No. PCT/JP2014/067626 filed on Jul. 2, 2014, which claims priority under 35 U.S.C §119 (a) to Japanese Patent Application No. 2013-161615 filed on Aug. 2, 2013. Each of the above application(s) is hereby expressly incorporated by reference, in its entirety, into the present application.

BACKGROUND OF THE INVENTION

1. Field of the Invention

The present invention relates to a conveyance device, an image-forming device, and a medium conveyance method, and particularly, to a medium conveyance technology by which a sheet medium is conveyed along an arc-shaped path.

2. Description of the Related Art

In an image-forming device such as a printing device, a technology for conveying a sheet (medium) using conveyance means such as a barrel (impression cylinder or transfer cylinder) or a chain gripper is known. In the conveyance using the barrel, a leading end portion of the sheet is held using a holding member referred to as a gripper, and the sheet is rotated and conveyed along a rotation path of the barrel.

In addition, in the conveyance using the chain gripper, the leading end portion of the sheet is held using a gripper attached to a pair of chains or a gripper disposed between a pair of chains, and the sheet is conveyed along the path of the chain.

In JP2009-285877A, JP2012-131065A, and JP2011-168019A, ink jet recording apparatuses are disclosed which include a plurality of impression cylinders and a transfer cylinder which transfers a medium between the impression cylinders as conveyance means of the medium (recording medium). The ink jet recording apparatus disclosed in JP2009-285877A includes injection means for injecting drying air to a medium, and negative-pressure means for suctioning a portion of the drying air while adsorbing a rear surface of the medium.

The ink jet recording apparatus disclosed in JP2012-131065A includes a drying unit which blows hot air so as to dry a medium (recording medium) which is conveyed using a drawing cylinder, and the dry unit is provided in a transfer cylinder. The dry unit disclosed in JP2012-131065A is fixed to a shaft which is rotatably attached around a rotation axis of the transfer cylinder, and it is possible to change a blowing direction of the hot air by rotating the shaft.

In addition, JP2012-131065A discloses that drying capability of the drying unit is adjusted so as to be optimal according to a kind of the medium (thick medium or thin medium).

The ink jet recording apparatus disclosed in JP2011-168019A includes cooling means for cooling a medium (recording medium) from when drawing is performed on the medium by a drawing unit until the medium is conveyed to a drying unit. In addition, this ink jet recording apparatus includes a ribbed guide member which bends a rear surface side of the medium so as to be convex and conveys the medium, and a hole through which cold air is released is provided in the ribbed guide member.

SUMMARY OF THE INVENTION

However, in the ink jet recording apparatus disclosed in JP2009-285877A, the negative pressure suctioning device functions as a guide portion which supports the rear surface of the medium. The drying air which is injected from the injection means toward the medium advances along a guide surface which guides the rear surface of the medium. If the air advancing along the guide surface enters a portion between the medium which is transferred from the drawing cylinder to the transfer cylinder and the drawing cylinder, the medium being peeled from an outer circumferential surface of the drawing cylinder may occur.

In the ink jet recording apparatus disclosed in JP2012-131065A, since the hot air is blown to the medium which is conveyed using the drawing cylinder, the hot air enters a portion between the drawing cylinder and the medium. As a result, the hot air advances between the outer circumferential surface of the drawing cylinder and the medium along the outer circumferential surface of the drawing cylinder. Accordingly, adsorption pressure acting on the medium from the drawing cylinder is decreased due to stiffness of the medium, and separation of a medium trailing end portion from the drawing cylinder occurs due to lifting of an intermediate portion of the medium.

In addition, in the ink jet recording apparatus disclosed in JP2012-131065A, since the hot air is blown to the drawing cylinder, the temperature of the drawing cylinder increases, and an increase in temperature of the medium held by the drawing cylinder or an increase of temperature around an ink-jet head disposed so as to be close to the drawing cylinder may influence image quality.

In the ink jet recording apparatus disclosed in JP2011-168019A, if the cold air which is not released from the hole of the guide member and remains between the guide member and the drawing cylinder advances along the guide member, separation of the medium from the drawing cylinder and flapping of the trailing end portion of the medium are likely to occur. In addition, when the cold air is blown to a portion between the drawing cylinder and the guide member, lifting occurs in the intermediate portion of the medium, and it is not possible to suppress the lifting of the intermediate portion of the medium.

The present invention is made in consideration of the above-described circumstance, and an object thereof is to provide a conveyance device, an image-forming device, and a medium conveyance method capable of preventing separation of a trailing end portion of a sheet medium due to lifting of an intermediate portion of the medium when the sheet medium is conveyed along an arc-shaped path.

In order to achieve the object, according to an aspect of the present invention, there is provided a conveyance device, comprising: a first conveyance unit that conveys a medium while fixing a first surface of the medium, configured to convey the medium along an arc-shaped path at a transfer position at which the medium is transferred to the downstream side in a conveyance direction in which the medium is conveyed; a second conveyance unit that is disposed on the downstream side of the first conveyance unit in the conveyance direction and includes a holding unit holding a leading end portion of the medium transferred from the first conveyance unit at the transfer position, configured to convey the medium transferred at the transfer position along the arc-shaped path on condition that a portion of the path is disposed at a position at which the portion of the path leads to the first conveyance unit side from the transfer position; and a blowing unit that is disposed on the second conveyance unit side from the transfer position and blows air from the second conveyance unit side to the first conveyance unit side on the downstream side of the transfer position in the conveyance direction, configured to blow air toward the medium conveyed by the second conveyance unit.

According to the present invention, in the conveyance device in which the first conveyance unit and the second conveyance unit convey the medium along the arc-shaped path at the position at which the medium is transferred from the first conveyance unit to the second conveyance unit, and which includes the conveyance path in which the conveyance path of the second conveyance unit leads to the first conveyance unit side, air is blown from the second conveyance unit side to the first conveyance unit side with respect to the medium which is transferred from the first conveyance unit to the second conveyance unit. Accordingly, since the medium is conveyed along the arc-shaped path of the second conveyance unit, separation of a trailing end portion of the medium due to lifting of an intermediate portion of the medium is prevented.

DESCRIPTION OF THE PREFERRED EMBODIMENTS

Hereinafter, a preferred embodiment of the present invention will be described in detail according to the accompanying drawings.

[Overall Configuration of Ink Jet Recording Apparatus]

Figure 1:
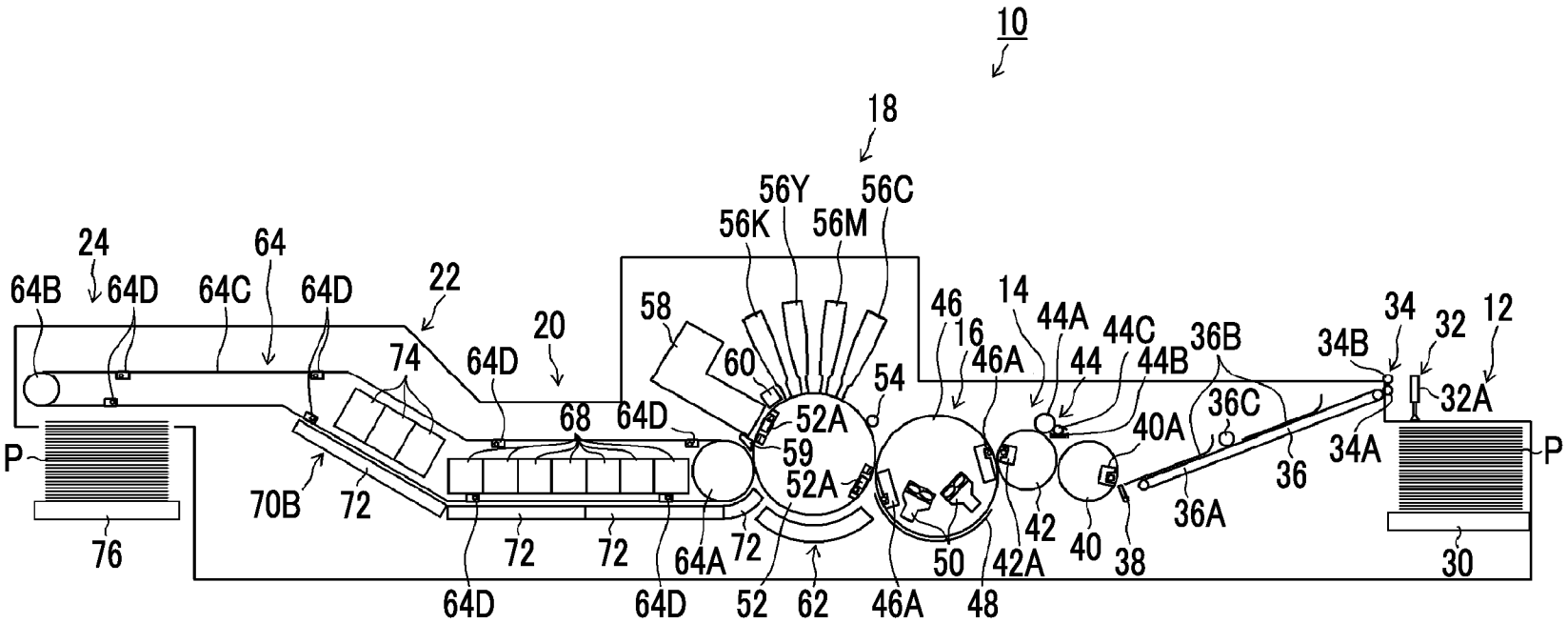
FIG. 1 is an overall configuration view of an ink jet recording apparatus to which a conveyance device according to an embodiment of the present invention is applied.

FIG. 1 is an overall configuration view of an ink jet recording apparatus to which an ink-jet head adjustment method according to an embodiment of the present invention is applied.

An ink jet recording apparatus 10 shown in FIG. 1 is an ink jet recording apparatus in which an image is recorded on a paper sheet P according to an ink-jet system using aqueous UV ink (ultraviolet (UV) curable ink using an aqueous medium).

The ink jet recording apparatus 10 includes a sheet feed portion 12, a treatment liquid application portion 14, a treatment liquid drying processing portion 16, an image-forming portion 18, an ink drying processing portion 20, a UV irradiation processing portion 22, and a sheet discharging portion 24. The sheet feed portion 12 feeds the sheet P. The treatment liquid application portion 14 applies a treatment liquid on a surface of the sheet P which is fed from the sheet feed portion 12. The treatment liquid drying processing portion 16 performs drying processing on the sheet P to which the treatment liquid is applied by the treatment liquid application portion 14. The image-forming portion 18 records an image on the surface of the sheet P, which is subjected to the drying processing by the treatment liquid drying processing portion 16, according to an ink-jet system using aqueous UV ink. The ink drying processing portion 20 performs the drying processing on the sheet P on which an image is recorded by the image-forming portion 18. The UV irradiation processing portion 22 fixes an image by irradiating the sheet P, which is subjected to the drying processing by the ink drying processing portion 20, with UV light (active light beam). The sheet discharging portion 24 discharges the sheet P which is subjected to the UV irradiation processing by the UV irradiation processing portion 22.

<Sheet Feed Portion>

The sheet feed portion 12 includes a sheet feed rack 30, a sucker device 32, a pair of sheet feed rollers 34, a feeder board 36, a front abutment 38, and a sheet feed drum 40, and the sheets P loaded on the sheet feed rack 30 are fed to the treatment liquid application portion 14 one by one.

The sheets P which are loaded on the sheet feed rack 30 are sequentially pulled up one by one from above by the sucker device 32 (suction fit 32A), and are fed to the pair of sheet feed rollers 34 (a portion between a pair of upper and lower rollers 34A and 34B).

The sheet P which is fed to the pair of sheet feed rollers 34 is sent forward by the pair of upper and lower rollers 34A and 34B, and is loaded on the feeder board 36. The sheet P which is disposed on the feeder board 36 is conveyed by a tape feeder 36A which is provided on a conveyance surface of the feeder board 36.

In addition, during a conveyance process, the sheet P is pressed to the conveyance surface of the feeder board 36 by a retainer 36B and a guide roller 36C, and unevenness is corrected. The leading end of the sheet P which is conveyed by the feeder board 36 comes into contact with the front abutment 38, an inclination of the sheet P is corrected, and thereafter, the sheet P is transferred to the sheet feed drum 40. In addition, the leading end portion of the sheet P is held by a gripper 40A of the sheet feed drum 40, and the sheet P is conveyed to the treatment liquid application portion 14.

<Treatment Liquid Application Portion>

The treatment liquid application portion 14 includes a treatment liquid application drum 42 which conveys the sheet P and a treatment liquid application unit 44 which applies a predetermined treatment liquid on the surface of the sheet P conveyed by the treatment liquid application drum 42, and the treatment liquid application portion 14 applies (coats) the treatment liquid on the surface of the sheet P.

The treatment liquid coated on the surface of the sheet P has a function which aggregates a color material in the aqueous UV ink which hits against the sheet P by the image-forming portion 18 in the subsequent stage. By hitting the aqueous UV ink against the sheet P in which the treatment liquid is coated on the surface, even when a general printing sheet is used, it is possible to perform high-quality printing without generating landing interference or the like.

The sheet P which is transferred from the sheet feed drum 40 of the sheet feed portion 12 is transferred to the treatment liquid application drum 42. In the treatment liquid application drum 42, the leading end of the sheet P is held (clamped) by the gripper 42A and is rotated, and the sheet P is wound around the circumferential surface of the drum and is conveyed.

During the conveyance process, the coating roller 44A, to which the treatment liquid measured to a constant amount from a treatment liquid tray 44B by an anilox roller 44C is applied, is pressed to and comes into contact with the surface of the sheet P, and the treatment liquid is coated on the surface of the sheet P. In addition, the coating aspect of the treatment liquid is not limited to the roller coating, and other aspects such as an ink-jet system or coating using a blade may be applied.

<Treatment Liquid Drying Processing Portion>

Treatment liquid drying processing portion 16 dries the sheet P in which treatment liquid is applied to the surface. The treatment liquid drying processing portion 16 includes a treatment liquid drying processing drum 46 which conveys the sheet P, a sheet conveyance guide 48 which supports (guides) the rear surface of the sheet P, and a treatment liquid drying processing unit 50 which blows hot air to the surface of the sheet P conveyed by the treatment liquid drying processing drum 46 so as to dry the surface of the sheet P.

The leading end of the sheet P which is transferred from the treatment liquid application drum 42 of the treatment liquid application portion 14 to the treatment liquid drying processing drum 46 is held by a gripper 46A included in the treatment liquid drying processing drum 46.

In addition, in a state where the surface (the surface which is coated with the treatment liquid) of the sheet P faces inward, the rear surface of the sheet P is supported by the sheet conveyance guide 48. In this state, the sheet P is conveyed by rotating the treatment liquid drying processing drum 46.

During the sheet P being conveyed by the treatment liquid drying processing drum 46, hot air is blown from the treatment liquid drying processing unit 50 which is installed inside the treatment liquid drying processing drum 46 to the surface of the sheet P, and the drying processing is performed on the sheet P. Accordingly, a solvent component in the treatment liquid is removed, and an ink aggregation layer is formed on the surface of the sheet P.

<Image-Forming Portion>

The image-forming portion 18 hits a droplet of ink (aqueous UV ink) of each of C, M, Y, and K against the surface of the sheet P on which a treatment liquid layer is formed, and draws a collar image on the surface of the sheet P. The image-forming portion 18 includes an image-forming drum 52 which conveys the sheet P, and a sheet pressing roller 54 which presses the sheet P conveyed by the image-forming drum 52 and causes the sheet P to come into close contact with a circumferential surface of the image-forming drum 52. In addition, the image-forming portion 18 includes ink-jet heads 56C, 56M, 56Y, and 56K which eject ink droplets of each of C, M, Y, and K onto the sheet P. Moreover, the image-forming portion 18 includes an inline sensor 58 which reads an image recorded on the sheet P, a mist filter 60 which captures ink mist, and a drum cooling unit 62.

Various ejection types such as a piezoelectric type (refer to FIG. 6) which ejects ink using deflection deformation of a piezoelectric element, a thermal type which heats ink so as to generate a film boiling phenomenon and ejects the ink, or an electrostatic type which lands charged ink onto a recording medium using an electrostatic force can be applied to the ink-jet head of the present example.

Figure 3:
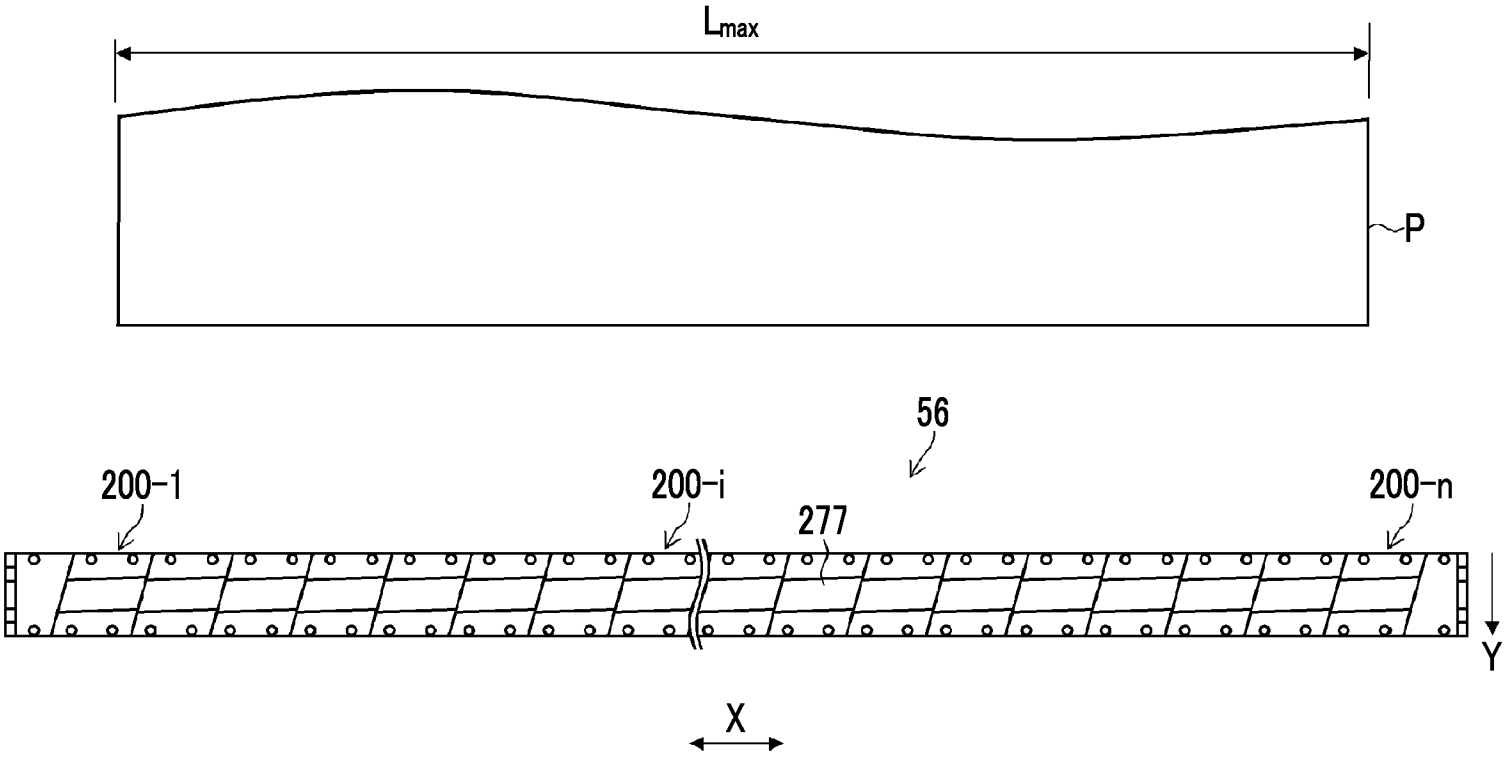
FIG. 3 is a configuration view of an ink-jet head included in the ink jet recording apparatus shown in FIG. 1.

In addition, a line type head, in which nozzles are formed over a length corresponding to the entire width (the length in a main scanning direction orthogonal to a relative movement direction of the sheet P) of the sheet P, is applied to the ink-jet head of the present example (refer to FIG. 3).

The leading end of the sheet P, which is transferred from the treatment liquid drying processing drum 46 of the treatment liquid drying processing portion 16 to the image-forming drum 52, is held by a gripper 52A included in the image-forming drum 52. In addition, the sheet P passes through the sheet pressing roller 54, and the sheet P comes into close contact with the circumferential surface of the image-forming drum 52.

The sheet P coming into close contact with the circumferential surface of the image-forming drum 52 is adsorbed to and held to the circumferential surface of the image-forming drum 52 by a negative pressure which is generated by adsorption holes formed on the circumferential surface of the image-forming drum 52.

When the sheet P, which is adsorbed and held to the circumferential surface of the image-forming drum 52 and is conveyed, passes an ink hit region immediately below each of the ink-jet heads 56C, 56M, 56Y, and 56K, ink droplets of each of C, M, Y, and K from each of the ink-jet heads 56C, 56M, 56Y, and 56K hit against the surface of the sheet P, and a collar image is drawn on the surface.

The ink which hits against the surface of the sheet P reacts with the ink aggregation layer which is formed on the surface of the sheet P and is fixed to the surface of the sheet P without generating feathering, bleeding, or the like, and a high-quality image is formed on the surface of the sheet P.

When the sheet P in which an image is formed by the ink-jet heads 56C, 56M, 56Y, and 56K passes through a reading region of the inline sensor 58, the image which is formed on the surface is read.

The reading of the image using the inline sensor 58 is performed if necessary, and inspection with respect to ejection failure, or image defects (image abnormality) such as density unevenness is performed based on the read data of the image. After the adsorption of the sheet P, which passes through the reading region of the inline sensor 58, is released, the sheet P passes through a guide 59 and is transferred to the ink drying processing portion 20.

<Ink Drying Processing Portion>

The ink drying processing portion 20 includes an ink drying processing unit 68 which performs drying processing with respect to the sheet P which is conveyed by a chain gripper 64, performs drying processing on the sheet P in which the image is formed, and removes a liquid component remaining on the surface of the sheet P.

As a configuration example of the ink drying processing unit 68, there is an aspect which includes a heat source such as a halogen heater or an infrared (IR) heater and a fan which blows air (gas, fluid) heated by the heat source to the sheet P.

The leading end of the sheet P, which is transferred from the image-forming drum 52 of the image-forming portion 18 to the chain gripper 64, is held by a gripper 64D included in the chain gripper 64.

The chain gripper 64 has a structure in which a pair of endless chains 64C is wound around a first sprocket 64A and a second sprocket 64B.

In addition, the rear surface of the trailing end of the sheet P is adsorbed and held to the sheet holding surface of a guide plate 72 which is disposed so as to be separated at a constant distant from the chain gripper 64.

<UV Irradiation Processing Portion>

The UV irradiation processing portion 22 (an active light beam irradiation unit) includes a UV irradiation unit 74, irradiates the image recorded using the aqueous UV ink with ultraviolet, and fixes the image on the surface of the sheet P.

For example, the UV irradiation unit includes an ultraviolet light source which generates UV light, and an optical system which functions as means for collecting UV light, means for deviating UV light, or the like.

If the sheet P which is conveyed by the chain gripper 64 reaches the UV light irradiation region of the UV irradiation unit 74, UV irradiation processing is performed by the UV irradiation unit 74 which is installed inside the chain gripper 64.

That is, in a state where the leading end of the sheet P is held by the gripper and the rear surface of the trailing end is adsorbed and held by the sheet holding surface, the sheet P is conveyed by the chain gripper 64. The surface of the sheet P is irradiated with the UV light emitted from the UV irradiation unit 74 which is disposed at a position corresponding to the surface of the sheet P in the conveyance route. In the image (ink) subjected to the irradiation of the UV light, a curing reaction is generated, and the image is fixed onto the surface of the sheet P.

The sheet P subjected to the UV irradiation processing is sent to the sheet discharging portion 24 via an inclination conveyance route 70B. The UV irradiation processing portion 22 may include a cooling processing portion which performs cooling processing on the sheet P passing through the inclination conveyance route 70B.

<Sheet Discharging Portion>

The sheet discharging portion 24, which recovers the sheets P subjected to the series of image-forming processing, includes a sheet discharging stand 76 which stacks and recovers the sheets P.

The chain gripper 64 (gripper 64D) releases the sheet P above the sheet discharge stand 76, and stacks the sheets P on the sheet discharging stand 76. The sheet discharging stand 76 stacks and recovers the sheet which is released from the chain gripper 64. In order to orderly stack the sheet P, a sheet abutment (not shown) (front sheet abutment, rear sheet abutment, lateral sheet abutment, or the like) is provided in the sheet discharging stand 76.

In addition, the sheet discharging stand 76 is liftably provided by a sheet discharging stand ascending and descending device (not shown). The driving of the sheet discharging stand ascending and descending device is controlled so as to be interlocked with an increase or a decrease of the sheets P stacked on the sheet discharging stand 76, and lifts or lowers the sheet discharging stand 76 so that the sheet P positioned at the highest position always has a constant height.

The ink jet recording apparatus 10 includes a blower unit (not shown in FIG. 1, and shown by a reference numeral 300 in FIGS. 2 and 8) between the pair of first sprockets 64A of the chain gripper 64.

By blowing wind (air) from the blow unit with respect to the surface (image-forming surface) of the sheet P immediately after the sheet P is transferred from the image-forming drum 52 to the chain gripper 64, intermediate lifting of the sheet P, which is conveyed by the chain gripper 64 and which is immediately after being transferred from the image-forming drum 52, is prevented. In addition, in the sheet P in which the leading end portion is held by the gripper 64D of the chain gripper 64 and the trailing end portion is adsorbed and held by the image-forming drum 52, separation of the trailing end portion from the image-forming drum 52 is prevented (described in detail below).

<Description of Control System>

Figure 2:
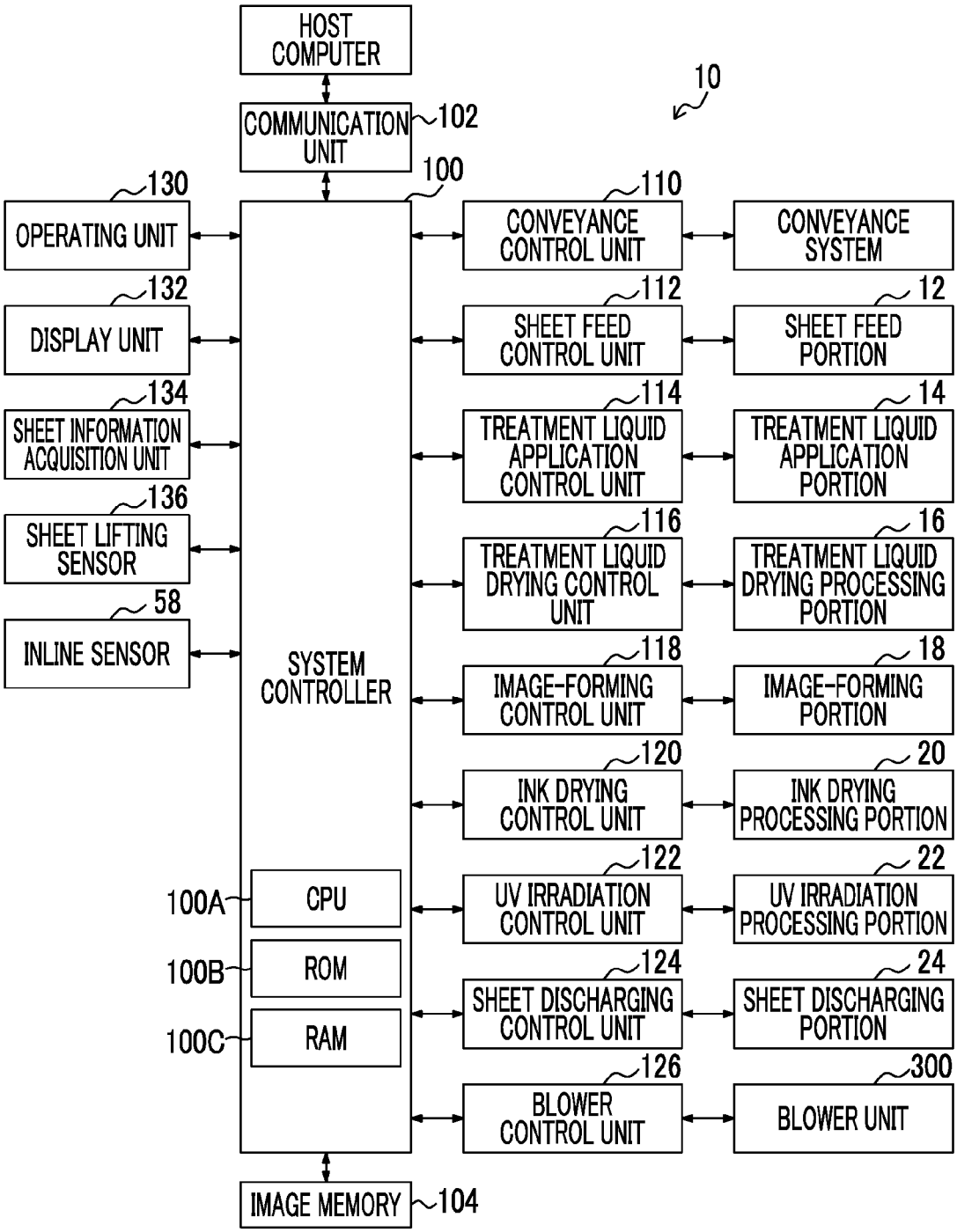
FIG. 2 is a block diagram showing a configuration of a control system of the ink jet recording apparatus shown in FIG. 1.

FIG. 2 is a block diagram showing a schematic configuration of a control system of the ink jet recording apparatus 10 shown in FIG. 1.

As shown in FIG. 2, the ink jet recording apparatus 10 includes a system controller 100, a communication unit 102, an image memory 104, a conveyance control unit 110, a sheet feed control unit 112, a treatment liquid application control unit 114, a treatment liquid drying control unit 116, an image-forming control unit 118, an ink drying control unit 120, a UV irradiation control unit 122, a sheet discharging control unit 124, an operating unit 130, a display unit 132, or the like.

The system controller 100 functions as a control unit that totally controls each portion of the ink jet recording apparatus 10, and functions as a calculation unit that performs various calculation processing. A Central Processing Unit (CPU) 100A, a Read Only Memory (ROM) 100B, and a Random Access Memory (RAM) 100C are built into the system controller 100.

The system controller 100 also functions as a memory controller which writes data to the memory such as the ROM 100B, the RAM 100C, or the image memory 104 and controls reading of the data from the memory.

FIG. 2 shows the aspect in which the memory such as the ROM 100B or the RAM 100C is built into the system controller 100. However, the memory such as the ROM 100B or the RAM 100C may be provided outside the system controller 100.

The communication unit 102 includes a required communication interface, and sends and receives data between a host computer connected to the communication interface and the communication unit 102.

The image memory 104 functions as an unit that temporarily stores various data including image data, and data is read from and written to the image memory 104 via the system controller 100. The image data which is received from the host computer via the communication unit 102 is temporarily stored in the image memory 104.

The conveyance control unit 110 controls an operation (conveyance of the sheet P from the sheet feed portion 12 to the sheet discharging portion 24) of a conveyance system of the sheet P in the ink jet recording apparatus 10. As shown in FIG. 1, the conveyance system includes the tape feeder 36A, a front abutment 38, and the sheet feed drum 40 in the sheet feed portion 12, the treatment liquid application drum 42 in the liquid application portion 14, the treatment liquid drying processing drum 46 in the treatment liquid drying processing portion 16, the image-forming drum 52 in the image-forming portion 18, and the chain gripper 64 which is commonly used in the ink drying processing portion 20, the UV irradiation processing portion 22, and the sheet discharging portion 24 (refer to FIG. 1).

The sheet feed control unit 112 controls the operation of each portion of the sheet feed portion 12 such as driving of the pair of sheet feed rollers 34 or driving of the tape feeder 36A according to a command from system controller 100.

The treatment liquid application control unit 114 controls the operation (an application amount of the treatment liquid, an application timing, or the like) of each portion of the treatment liquid application portion 14 such as the operation of the treatment liquid application unit 44 according to the command from the system controller 100.

The treatment liquid drying control unit 116 controls the operation of each portion of the treatment liquid drying processing portion 16 according to the command from the system controller 100. That is, the treatment liquid drying control unit 116 controls of the operation of the treatment liquid drying processing unit 50 (refer to FIG. 1) such as drying temperature, a flow rate of drying air, or an injection timing of the drying air.

The image-forming control unit 118 controls ink hitting (ejection) from the image-forming portion 18 (ink-jet heads 56C, 56M, 56Y, and 56K, refer to FIG. 1) according to the command from the system controller 100.

That is, the image-forming control unit 118 of FIG. 2 includes an image processing unit which forms dot data from input image data, a waveform generation unit (not shown) which generates waveforms of a driving voltage, and a waveform storage unit which stores the waveforms of the driving voltage. In addition, the image-forming control unit 118 includes a driving circuit which supplies the driving voltage having driving waveforms corresponding to the dot data with respect to each of the ink-jet heads 56C, 56M, 56Y, and 56K.

In the image processing unit, color separation (separation draft) processing which separates input image data (raster data represented by digital values of 0 to 255) into each color of RGB, color conversion processing which converts RGB into CMYK, correction processing such as a gamma correction or an unevenness correction, half-tone processing which converts data of each color of M value into data of each color of N value (M>N, M is a constant of 3 or more, and N is a constant of 2 or more) are performed.

A hitting timing and a hitting amount of ink at each pixel position are determined based on dot data generated by processing of the image processing unit, and the driving voltage and driving signals (control signals which determines the hitting timing of each pixel) corresponding to the hitting timing and the hitting amount of ink at each pixel position are generated. The driving voltage is input to the ink-jet heads 56C, 56M, 56Y, and 56K, and dots are generated at each pixel position by ink droplets hit from ink-jet heads 56C, 56M, 56Y, and 56K.

The ink drying control unit 120 controls the operation of the ink drying processing portion 20 according to the command from the system controller 100. That is, the ink drying control unit 120 controls the operation of the ink drying processing unit 68 (refer to FIG. 1) such as drying temperature, a flow rate of drying air, or an injection timing of the drying air.

The UV irradiation control unit 122 controls an irradiation light quantity (strength (irradiation quantity) of UV light) of UV light by the UV irradiation processing portion 22 according to the command from the system controller 100, and controls an irradiation timing of the UV light.

The sheet discharging control unit 124 controls the operation of the sheet discharging portion 24 such that the sheets P are stacked on the sheet discharging stand 76 (refer to FIG. 1) according to the command from the system controller 100.

The operating unit 130 includes an operation member such as an operation button, a keyboard, or a touch panel, and sends operation information input from the operation member to the system controller 100. The system controller 100 performs various processing according to the operation information sent from the operating unit 130.

The display unit 132 includes a display station such as an LCD panel, and displays information such as various setting information of the device or abnormality information on the display station according to the command of the system controller 100.

Processing such as noise removal or waveform shaping is performed on the detection signals (detection data) output from the inline sensor 58, and the processed detection signals are stored in a predetermined memory (for example, RAM 100C) via the system controller 100.

The blower control unit 126 (a blowing control unit) controls the operation (air volume or the like) of the blower unit 300 based on the command signals sent from the system controller 100. In the control of the blower unit 300, the information of the sheet P acquired from the sheet information acquisition unit 134 is used.

The sheet information acquisition unit 134 (a medium information acquisition unit) acquires the information of the sheet P which is fed from the sheet feed portion 12. The acquired information of the sheet P is stored in a predetermined memory (sheet information storage unit). The stored information of the sheet is referred to by the blower control unit 126, and is used for the control of the blower.

The information of the sheet includes at least the information of the thickness of the sheet P. In addition, the information of the sheet may include a kind of the sheet P, stiffness of the sheet P (information representing strength of stiffness), or the like.

A sheet lifting detection unit 136 includes a sheet lifting sensor which is disposed on the downstream side of the sheet pressing roller 54 (refer to FIG. 1) in the sheet conveyance direction and is disposed on the upstream side of the ink-jet heads 56C, 56M, 56Y, and 56K in the sheet conveyance direction, and detects whether or not at least one of lifting of the sheet P adsorbed and held by the image-forming drum 52 and a height of separation of the sheet P is a reference value or more.

The determination (detection) results of the sheet lifting detection unit 136 are supplied to the conveyance control unit 110 via the system controller 100, and are used for the conveyance control of the sheet P. The determination results of the sheet lifting detection unit 136 may be used for information which determines whether or not the sheet P is supplied to the image-forming drum 52.

[Structure of Ink-Jet Head]

Next, a structure of the ink-jet head according to the embodiment of the present invention will be described in detail.

<Overall Structure>

FIG. 3 is a configuration view of the ink-jet heads 56C, 56M, 56Y, and 56K shown in FIG. 1. Since the ink-jet heads 56C, 56M, 56Y, and 56K corresponding to each of CYMK have the same structure as one another, when it is not necessary to classify the ink-jet heads 56C, 56M, 56Y, and 56K, letters of the ink-jet heads 56C, 56M, 56Y, and 56K may be omitted.

The ink-jet head 56 shown in FIG. 3 has a structure in which a plurality of head modules 200 are combined in a width direction (X direction) of the sheet P orthogonal to a relative conveyance direction (Y direction) of the sheet P.

A branch number (a constant assigned after a hyphen (-)) assigned to the head module 200 indicates an ith head module (i is a constant between 1 and n).

A plurality of nozzle openings (not shown in FIG. 3, and shown by a reference numeral 280 in FIG. 5) are disposed on the ink ejection surface 277 of each head module 200.

That is, the ink-jet head 56 shown in FIG. 3 is a full-line type ink-jet head (a single pass page wide head) in which a plurality of nozzle openings are disposed over a length corresponding to the entire width $L_{max}$ of the sheet P.

Here, the "entire width $L_{max}$ of the sheet P" is the entire length of the sheet P in the X direction orthogonal to the relative conveyance direction (Y direction) of the sheet P. In addition, here, the "orthogonal" includes an aspect in which effects similar to a case where intersection is performed so as to substantially form an angle of 90° are generated, in an aspect in which intersection is performed so as to form an angle less than 90° and an aspect in which intersection is performed so as to form an angle exceeding 90°.

<Structure Example of Head Module>

Figure 4:
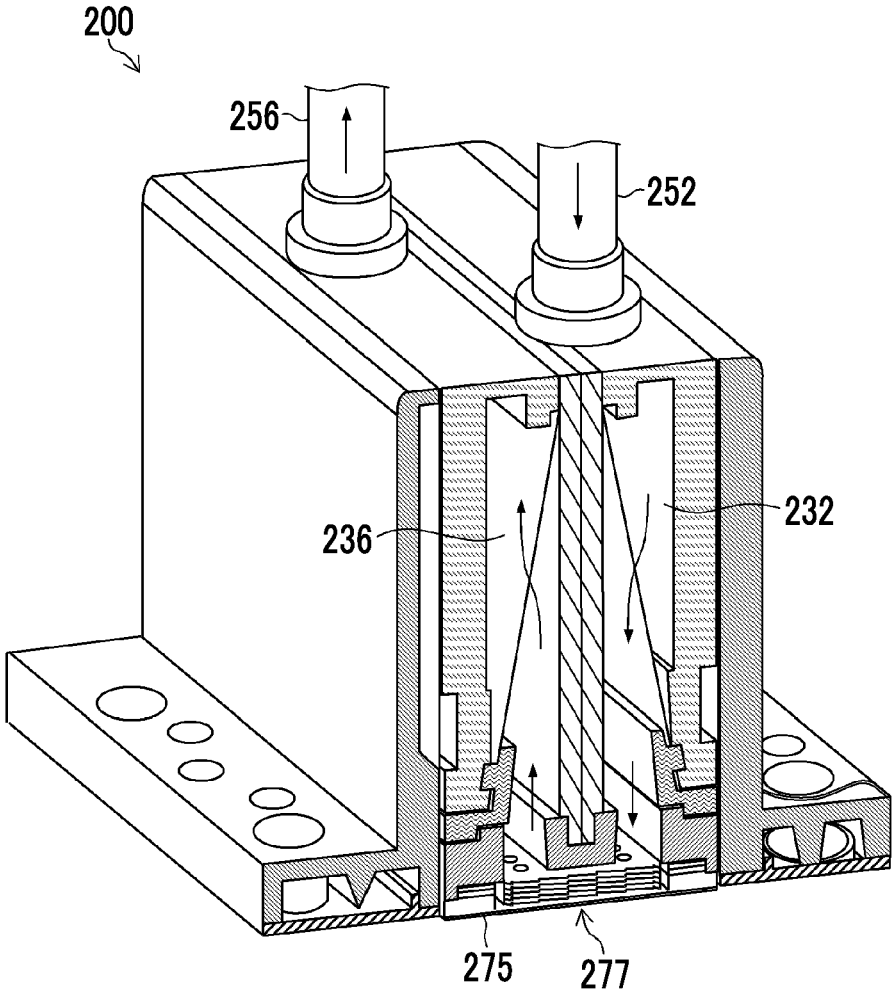
FIG. 4 is a perspective view showing a configuration example of a head module included in the ink-jet head shown in FIG. 3.
Figure 5:
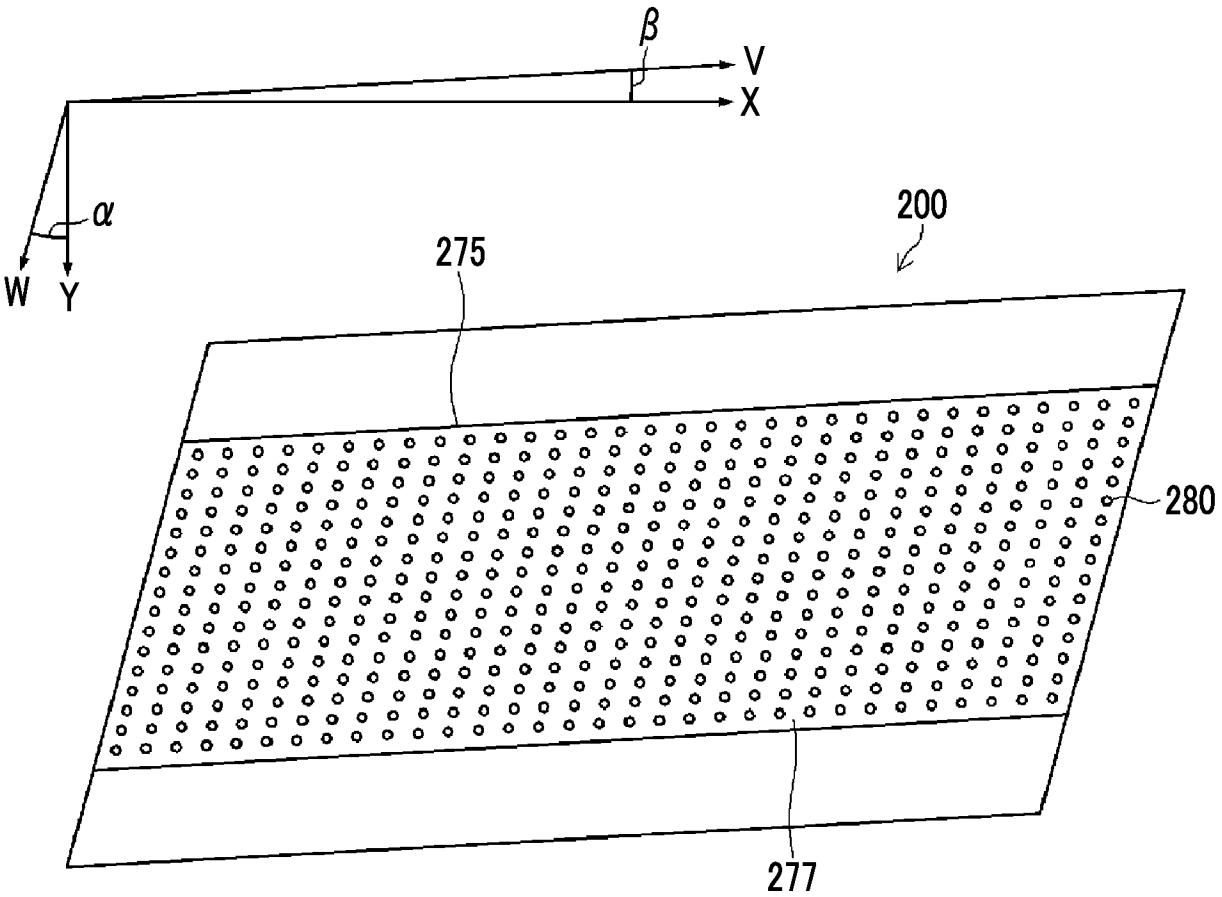
FIG. 5 is an explanatory view of a nozzle arrangement of the head module shown in FIG. 4.

FIG. 4 is a perspective view (including a partial sectional view) of the head module 200 and FIG. 5 is a plan perspective view of the nozzle surface of the head module 200 shown in FIG. 4.

As shown in FIG. 4, the head module 200 includes an ink supply unit which includes an ink supply chamber 232, an ink circulation chamber 236, or the like on a side (upper side in FIG. 4) opposite to an ink ejection surface 277 of a nozzle plate 275.

The ink supply chamber 232 is connected to an ink tank (not shown) via a supply pipe line 252, and an ink circulation chamber 236 is connected to a recovery tank (not shown) via a circulation pipe line 256.

In FIG. 5, the nozzles are shown in a state where the number of the nozzles is not considered. However, a plurality of nozzle openings 280 are formed on the ink ejection surface 277 of the nozzle plate 275 of one head module 200 according to a two-dimensional nozzle arrangement.

That is, the head module 200 has a parallelogram planar shape which includes an end surface of a long side along a V direction having an inclination of an angle β in the X direction, and an end surface of a short side along a W direction having an inclination of an angle α in the Y direction. The plurality of nozzle openings 280 are disposed in a line direction along the V direction and a column direction along the W direction.

In addition, the disposition of the nozzle openings 280 are not limited to the aspect shown in FIG. 5. The plurality of nozzle openings 280 may be disposed in the line direction along the X direction, and in the column direction obliquely intersecting the X direction.

Figure 6:
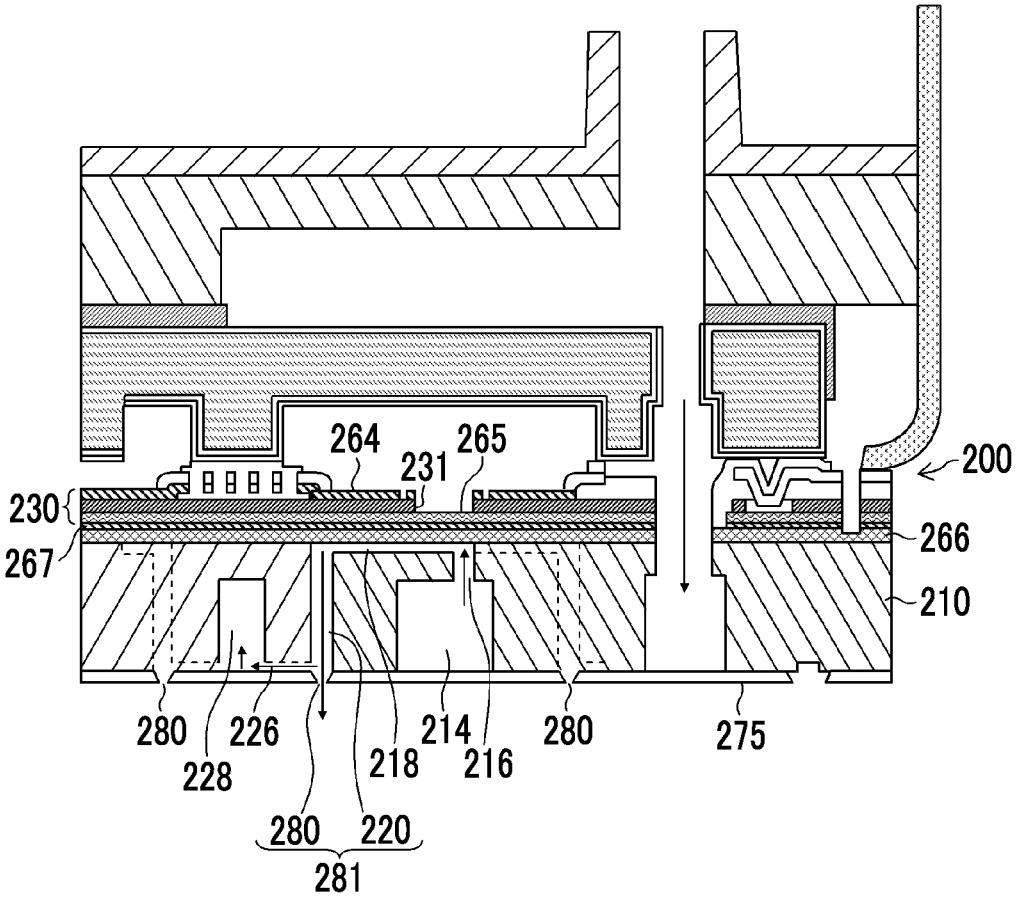
FIG. 6 is a sectional view showing an internal structure of the head module shown in FIG. 4.

FIG. 6 is a sectional view showing an internal structure of the head module 200. A reference numeral 214 indicates an ink supply path, 218 indicates a pressure chamber (liquid chamber), 216 indicates an individual supply path which connects each pressure chamber 218 and the ink supply path 214, 220 indicates a nozzle communication path which connects the pressure chamber 218 and the nozzle opening 280, and 226 indicates a circulation individual channel which connects the nozzle communication path 220 and the circulation common channel 228.

A vibration plate 266 is provided on a channel structure 210 which configures the channel portions (214, 216, 218, 220, 226, and 228). A piezoelectric element 230, which is configured of a lamination structure including a lower electrode (common electrode) 265, a piezoelectric layer 231, and an upper electrode (individual electrode) 264, is disposed on the vibration plate 266 via an adhesive layer 267.

The upper electrode 264 is an individual electrode which is patterned according to the shape of each pressure chamber 218, and the piezoelectric element 230 is provided for each pressure chamber 218.

The ink supply path 214 is connected to the ink supply chamber 232 described with reference to FIG. 4, and ink is supplied from the ink supply path to the pressure chamber 218 via the individual supply path 216. By applying the driving voltage to the upper electrode 264 of the piezoelectric element 230 provided in the corresponding pressure chamber 218 according to the image signals of the image to be drawn, the piezoelectric element 230 and the vibration plate 266 are deformed, and volume of the pressure chamber 218 is changed. Ink is ejected from the nozzle opening 280 via the nozzle communication path 220 by a pressure change according to the change of the volume.

By controlling the driving of the piezoelectric element 230 corresponding to each nozzle opening 280 according to dot disposition data generated from the image information, it is possible to eject an ink droplet from the nozzle opening 280. By controlling a timing of ink ejection from each nozzle opening 280 in accordance with the conveyance speed while conveying the sheet P (refer to FIG. 3) in the Y direction at a constant speed, it is possible to record a desired image on the sheet.

Although it is not shown, a planar shape of the pressure chamber 218 provided corresponding to each nozzle opening 280 is approximately square, an outflow port to the nozzle opening 280 is provided on one of both corner portions on a diagonal line, and an inflow port (individual supply path) 216 of the supply ink is provided on the other.

In addition, the shape of the pressure chamber is not limited to a square. The planar shape of the pressure chamber may be various shapes such as a quadrangle (a diamond shape, a rectangular shape, or the like), a pentagon, a hexagon, a polygon, a circular shape, or an elliptic shape.

A circulation outlet (not shown) is formed in a nozzle portion 281 including the nozzle opening 280 and the nozzle communication path 220, and the nozzle portion 281 communicates with the circulation individual channel 226 via the circulation outlet.

In the ink of the nozzle portion 281, ink which is not used for ejection is recovered (circulated) to the circulation common channel 228 via the circulation individual channel 226.

The circulation common channel 228 is connected to the ink circulation chamber 236 described with reference to FIG. 5, and the ink is always recovered to the circulation channel 228 through the circulation individual channel 226, and thickening of the ink in the nozzle portion during non-ejection (non-driving) is prevented.

In the above-described ink jet recording apparatus 10, the image-forming drum 52 of the image-forming portion 18 and the chain gripper 64 function as a conveyance device of the sheet P in the image forming processing and in the processing process after the image forming processing.

Hereinafter, a conveyance device will be described, which is configured so as to include the conveyance drum (impression cylinder) positioned on the upstream side in the conveyance direction of the sheet P and a chain conveyance portion (chain gripper) positioned on the downstream side in the conveyance direction. In addition, in descriptions below, the same reference numerals are assigned to the same configurations as those of FIGS. 1 to 6 or portions similar to those of FIGS. 1 to 6, and descriptions thereof are omitted.

[Detail Description of Conveyance Device]

<Description of Problem>

Figure 7:
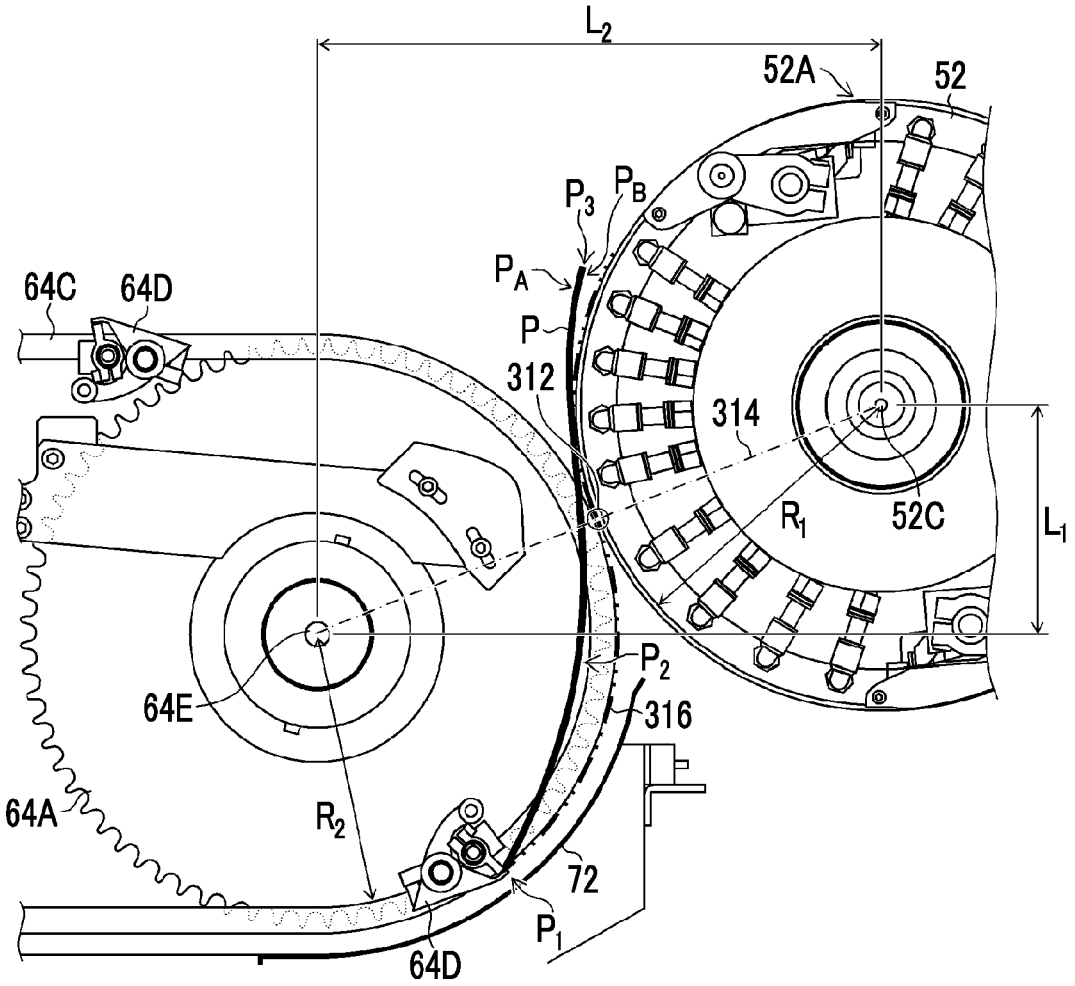
FIG. 7 is an explanatory view of problems to be solved by the present invention.

FIG. 7 is an explanatory view of a technical problem to be solved by the conveyance device according to the embodiment of the present invention. FIG. 7 is a side view when the image-forming drum 52 (a first conveyance unit) and the chain gripper 64 (a second conveyance unit) are viewed in a direction orthogonal to the conveyance direction of the sheet P, and the vicinity of a transfer position 312 of the sheet P (medium) between the image-forming drum 52 and the chain gripper 64 is shown so as to be enlarged.

The conveyance device shown in the present example includes an S-shaped conveyance route in which the sheet P is conveyed along an S shape before and after a position at which the sheet P is transferred from the image-forming drum 52 which adsorbs and holds a rear surface $P_B$ (first surface) opposite to a surface $P_A$ on which the image of the sheet P is formed and conveys the sheet P to the chain gripper 64 which holds the leading end $P_1$ of the sheet P and conveys the sheet P in a state where the surface $P_A$ (second surface) and the rear surface $P_B$ are not held (fixed).

In the "S-shaped conveyance route", in the image-forming drum 52 which is the sheet conveyance unit on the upstream side in the conveyance direction of the sheet P and the chain gripper 64 which is the sheet conveyance unit on the downstream side in the conveyance direction, the conveyance path of the sheet P at the transfer position 312 at which the sheet P is transferred from the image-forming drum 52 to the chain gripper 64 is an arc shape (nonlinear), and the S-shaped conveyance route is a conveyance route of the sheet P having a conveyance path in which the conveyance path of the sheet P of the image-forming drum 52 is led to the chain gripper 64 from the transfer position 312, and the conveyance path of the sheet P of the chain gripper 64 is led to the image-forming drum 52.

That is, the S-shaped conveyance route is defined as follows with respect to a relationship between a position of a rotation center 52C of the image-forming drum 52 and a position of a path center 64E of the chain gripper 64 (first sprocket 64A and second sprocket 64B). The position of the rotation center 52C of the image-forming drum 52 and the position of the path center 64E of the chain gripper 64 are deviated from each other in a vertical direction (a direction orthogonal to a horizontal surface). That is, a distance in the vertical direction between the position of the rotation center 52C of the image-forming drum 52 and the path center 64E of the chain gripper 64 is $L_1$ (>0). In addition, in a horizontal direction (a direction parallel to the horizontal surface), a distance $L_2$ between the rotation center 52C of the image-forming drum 52 and the path center 64E of the chain gripper 64 is less than a value in which a rotation radius $R_1$ of the image-forming drum 52 and a rotation radius $R_2$ of the chain gripper 64 are added ($L_2<R_1$ and $R_2$).

The transfer position 312 of the sheet P is an intersection point (intersection surface) between a line (surface) 314 (a path center line shown by a chain line) which connects the rotation center (rotation axis) 52C of the image-forming drum 52 and the path (rotation) center (rotation axis of the first sprocket 64A) 64E of the chain gripper 64, and an S-shaped conveyance route 316 (shown by two-dot chain line) of the sheet P.

As shown in FIG. 7, in the sheet P which is transferred from the image-forming drum 52 to the chain gripper 64, an intermediate portion $P_2$ is separated from the path of the chain gripper 64 (a circumferential surface path along outer circumferential surface of a virtual cylinder having the first and second sprockets 64A and 64B as the bottom surface). In addition, a trailing end $P_3$ is separated from the outer circumferential surface of the image-forming drum 52 due to the separation (intermediate separation) of the intermediate portion $P_2$. This phenomenon is remarkably generated when stiffness of the sheet P such as a thick sheet is high (stiffness is strong).

In general, the entire sheet P in which the leading end $P_1$ is held by the gripper 64D of the chain gripper 64 moves along the trajectory of the leading end $P_1$ (S-shaped conveyance route shown by the two-dot chain line indicated by the reference numeral 316), and the sheet P is conveyed while the rear surface (the surface opposite to the surface on which the image is formed) is guided by the guide plate 72. However, the sheet P shown in FIG. 7 is brought into a flat state without being deformed along the S shape, and intermediate separation is generated.

Accordingly, an object of the conveyance device shown in the present example is to prevent separation of the trailing end $P_3$ from the image-forming drum 52 in the sheet P in which the leading end $P_1$ is held by the gripper 64D of the chain gripper 64 and the trailing end $P_3$ is adsorbed and held by the image-forming drum 52, and the conveyance device adopts the following configurations.

<Descriptions of Sheet Conveyance in Image-Forming Portion>

First, the conveyance of the sheet P in the image-forming portion 18 (refer to FIG. 1) will be described. When the sheet P is fed to the image-forming drum 52, the leading end $P_1$ (refer to FIG. 7) of the sheet P is held by the gripper 52A of the image-forming drum 52. The sheet P in which the leading end $P_1$ is held is conveyed to the downstream side in the conveyance direction by the rotation of the image-forming drum 52.

In order to convey the entire surface of the sheet P conveyed by the image-forming drum 52 so as to be flat (so as to cause the entire surface to come into close contact with the outer circumferential surface of the image-forming drum 52), the sheet P is adsorbed to the outer circumferential surface of the image-forming drum 52. The sheet P is pressed to the outer circumferential surface of the image-forming drum 52 by the sheet pressing roller 54 (refer to FIG. 1) which is positioned before the adsorption start position in the sheet conveyance direction, and comes into close contact with the outer circumferential surface of the image-forming drum 52.

According to a sheet lifting detection portion which includes the sheet lifting sensor 136 (refer to FIG. 2) disposed on the downstream side in the sheet conveyance direction of the sheet pressing roller 54, at least one of sheet lifting and sheet separation is detected. When it is determined that at least one of the sheet lifting and the sheet separation is equal to or more than a predetermined value by the sheet lifting detection unit, the conveyance control unit 110 stops the conveyance of the sheet P performed by the image-forming drum 52. Accordingly, entrance of the sheet P immediately below the ink-jet heads 56C, 56M, 56Y, and 56K (refer to FIG. 1) is prevented.

An image which is ejected from the ink-jet heads 56C, 56M, 56Y, and 56K (an image-forming unit) is formed on the surface of the sheet P in which it is determined that the sheet lifting and the sheet separation is less than a predetermined value by the sheet lifting detection unit.

The sheet P in which an image is drawn on the surface is conveyed to the downstream side of the ink-jet heads 56C, 56M, 56Y, and 56K in the sheet conveyance direction (first conveyance process), and is transferred from the image-forming drum 52 to the chain gripper 64 at the transfer position (indicated by the reference numeral 312 in FIG. 7) of the sheet P between the image-forming drum 52 and the chain gripper 64.

The leading end $P_1$ of the sheet P which is transferred to the chain gripper 64 is held by the gripper 64D, and is conveyed along the path of the chain 64C. The chain gripper 64 conveys the sheet P in a state where the surface $P_A$ (refer to FIG. 7) and the rear surface $P_B$ are not held. The surface $P_A$ of the sheet P is guided by the guide plate 72 (second conveyance process).

<Configuration of Conveyance Device>

Figure 8:
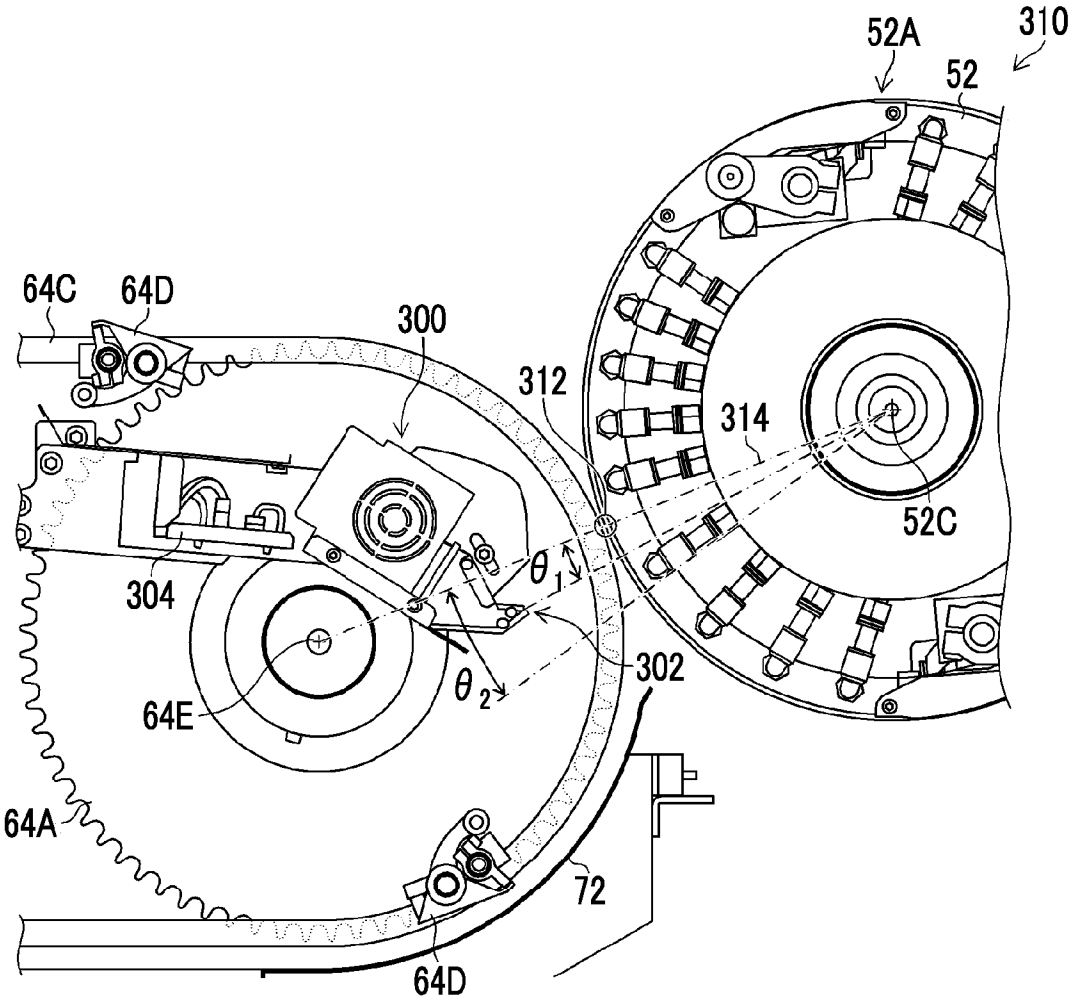
FIG. 8 is a schematic configuration view of the conveyance device which is applied to the ink jet recording apparatus shown in FIG. 1.

FIG. 8 is a schematic configuration view of the conveyance device 310 according to the embodiment of the present invention. The conveyance device 310 shown in FIG. 8 includes a blower unit 300 (a blowing unit) which blows wind (air) to the sheet P (not shown in FIG. 8 and refer to FIG. 13) during the conveyance from the chain gripper 64 side toward the image-forming drum 52 side.

By blowing air from the blower unit 300 to the intermediate portion $P_2$ (refer to FIG. 7) of the sheet P (blowing process), the sheet P follows the conveyance path of the chain gripper 64 in a state where the sheet P does not come into contact with the conveyance path (a virtual cylindrical outer circumferential surface) of the chain gripper 64. As a result, separation of the intermediate portion $P_2$ of the sheet P from the conveyance path of the chain gripper 64 (leading of the intermediate portion $P_2$ to the inner portion of the chain gripper 64) is prevented, and separation of the trailing end $P_3$ (refer to FIG. 7) of the sheet P from the image-forming drum 52 is prevented.

The blow unit 300 is disposed inside the path around the chain gripper 64. That is, the blower unit 300 is disposed between the pair of first sprockets 64A, and the position of the blower unit 300 is fixed by a support member 304. In addition, FIG. 8 shows a state where the front sprocket (not shown) of the pair of first sprockets 64A is projected.

The blower unit 300 includes a nozzle 302, and the nozzle 302 is disposed toward the rotation center 52C of the image-forming drum 52 so as to be lowered by an angle $\theta_1$ in terms of a rotation angle of the image-forming drum 52 from the path center line 314.

The nozzle 302 may be disposed at a position which is lowered by an angle $\theta_2$ in terms of the rotation angle of the image-forming drum 52 from the path center line 314. From the viewpoint of effectively preventing the intermediate separation of the sheet P, the angles $\theta_1$ and $\theta_2$ can be appropriately selected. In the conveyance device 310 (ink jet recording apparatus 10) shown in the present example, it is experimentally confirmed that the angle $\theta_1$ may be set to 10° and the angle $\theta_2$ may be set to 15°.

The adsorption of the sheet P with respect to the image-forming drum 52 is terminated at the transfer position 312 of the sheet P. In addition, the suction with respect to the image-forming drum 52 may be terminated before the transfer position 312 of the sheet P. For example, the suction of the sheet P with respect to the image-forming drum 52 may stop before approximately 10° in terms of the rotation angle of the image-forming drum 52 from the transfer position 312 of the sheet P.

Figure 9:
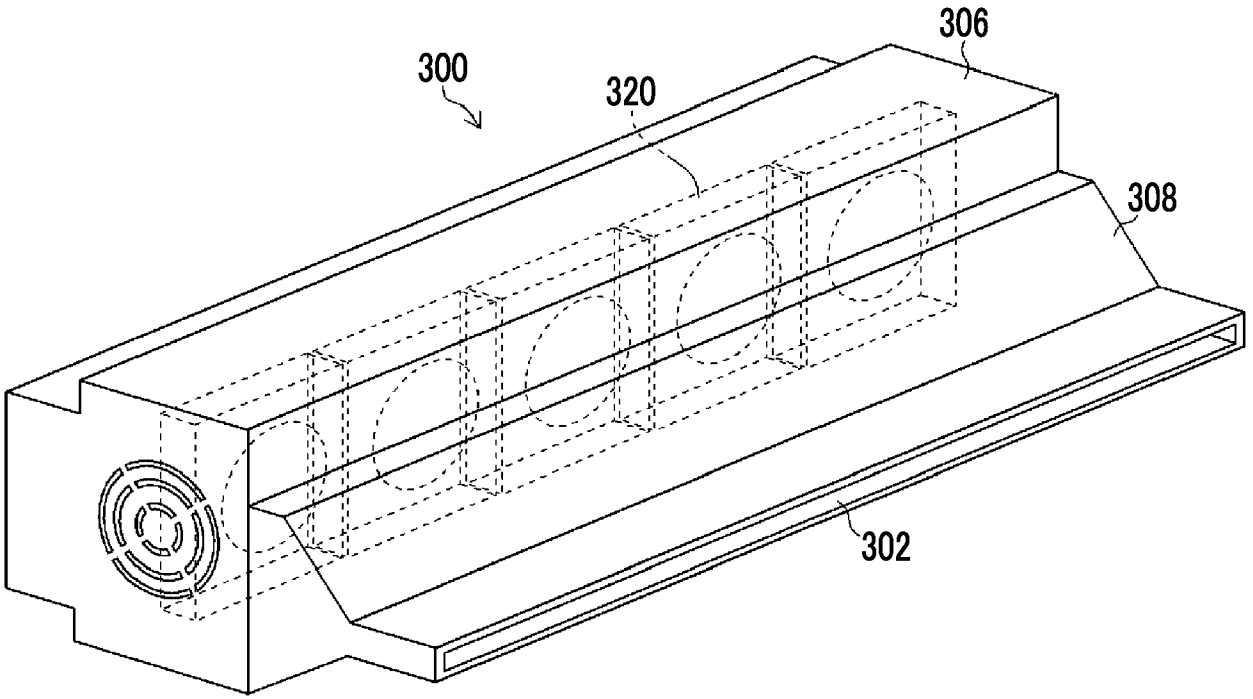
FIG. 9 is a perspective view showing a schematic configuration of a blower unit.
Figure 10:
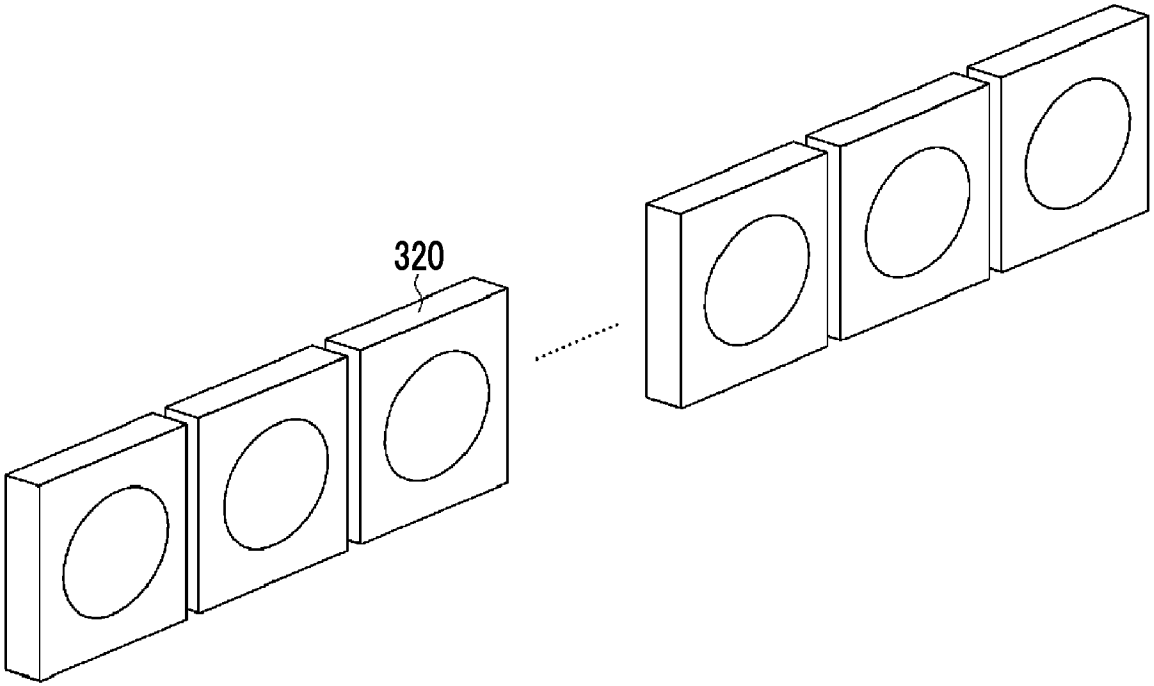
FIG. 10 is a perspective view showing a disposition example of a blower.

FIG. 9 is a perspective view showing a schematic configuration of the blower unit 300. In addition, FIG. 10 is a view showing a disposition example of a plurality of blowers 320 which are built into the blower unit 300. In addition, in FIGS. 9 and 10, some blowers 320 disposed on the intermediate portion of the blower unit 300 are not shown.

The blower unit 300 shown in FIG. 9 has an internal structure in which the plurality of blowers 320 (shown by broken lines) are arranged in one row along the longitudinal direction of the blower unit 300 inside a main body case 306. The plurality of blowers 320 have the same shape and the same specification.

An amount of air blown (rotating speed) and ON-OFF are controlled with respect to each of the plurality of blowers 320 shown in FIGS. 9 and 10.

The nozzle 302 is provided on the tip of a discharging portion 308 of the blower unit 300. The wind from the plurality of blowers 320 is combined by the nozzle 302, the channel of the wind is narrowed by the shape of the discharging portion 308, and wind speed from the blower unit 300 is higher than the wind speed of the blower 320.

An opening of the nozzle 302 is formed in a long hole which extends in the longitudinal direction of the blower unit 300. The opening shape of the nozzle 302 may be a rectangular shape, an elliptical shape, or the like. By setting the length (opening length) in the longitudinal direction of the nozzle 302 so as to be equal to or more than the maximum width of the used sheet P, it is possible to allow wind to come into contact with the entire width of each of the sheets P of all sizes.

In order to cope with the sheet P having a different width, a partition may be provided in the nozzle 302. In addition, the nozzle 302 may include a shielding member which shields a portion of the opening of the nozzle 302.

Moreover, by allowing a length (opening width) in a lateral direction of the nozzle 302 to be uniform, it is possible to cause wind having a uniform air volume to come into contact with the sheet P in the width direction of the sheet P.

Moreover, the configuration and the shape of the blower unit 300 are not limited to the configuration and the shape shown in FIGS. 9 and 10. As long as similar effects can be obtained, the configuration and the shape may be appropriately modified, added, or removed.

The operation of the blower 320 which is built into the blower unit 300 is controlled by the blower control unit 126 shown in FIG. 2. In the blower unit 300 shown in the present example, by changing the air volume of the blower 320 or changing the number of the operated blowers, it is possible to change the air volume which is blown from the blower unit 300.

For example, as for a thickness of the sheet P, the air volume relatively increases in a case where the sheet P is relatively thick, and the air volume decreases in a case where the sheet P is relatively thin. In order to increase the air volume, the rotating speed of the blower 320 increases or the number of the used blowers 320 increases. In order to decrease the air volume, the rotating speed of the blower 320 decreases or the number of the used blowers 320 decreases.

As for stiffness of the sheet P instead of the thickness of the sheet P, the air volume may relatively increase in a case where the stiffness is relatively high, and the air volume may relatively decrease in a case where the stiffness is relatively low. At least one of thickness information and stiffness information of the sheet P is acquired by the sheet information acquisition unit 134 of FIG. 2.

A relationship between the thickness (stiffness) of the sheet P, the air volume (the number of blowers), or the like and a control parameter is stored in advance, the control parameter of the blower unit 300 is read based on the acquired sheet information, and the blower unit 300 may be operated using the read control parameter.

<Description of Sheet Conveyance Control Flow>

Figure 11:
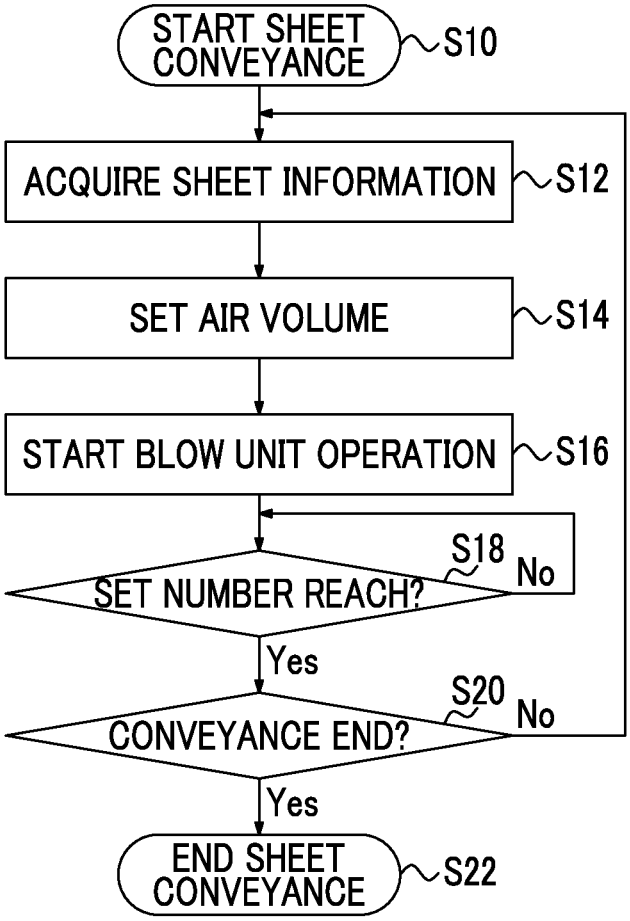
FIG. 11 is a flowchart showing a flow of a control of the conveyance device according to the embodiment of the present invention.

FIG. 11 is a flowchart showing a flow of a sheet conveyance control which is applied to the conveyance device 310. If the sheet P is fed, the conveyance of the sheet P starts (Step S10). When the sheet P is fed, the sheet information is acquired (Step S12), the air volume of the blower unit 300 is set according to the sheet information (Step S14), and the operation of the blower unit 300 starts (Step S16).

In addition, the ink jet recording apparatus 10 may include an entrance detection unit which detects the sheet P entering the blowing region of the blower unit 300. Based on the detection performed by the entrance detection unit, the operation of the blower unit 300 may start immediately before the sheet P enters the blowing region of the blower unit 300, and the operation of the blower unit 300 may stop when the sheet P is discharged from the blowing region of the blower unit 300.

In addition, the feed number of the sheets P is counted when the sheets P are fed, and the set number which is set in advance and the count value of the feed number (the number of the sheets which are actually fed) are compared (Step S18). In Step S18, if it is determined that the count value of the feed number does not reach the set number (No), Step S18 continues.

Meanwhile, in Step S18, if it is determined that the count value reaches the set number (Yes), the step proceeds to Step S20, and it is determined whether or not a conveyance end command is performed. In the case of the ink jet recording apparatus shown in the present example, the conveyance end command of Step S20 in FIG. 11 corresponds to an image-forming (printing) end command.

In Step S20, if it is determined that the conveyance end command is not performed (No), the step proceeds to Step S12, and processes from Step S12 to Step S20 are repeatedly performed. Meanwhile, in Step S20, if it is determined that conveyance end command is performed (Yes), the conveyance end processing is performed, and the sheet conveyance ends (Step S22).

This sheet conveyance control can be applied to not only the sheet conveyance during the image forming performed by the image-forming portion 18 (refer to FIG. 1) but also the conveyance control of the sheet P in each device of the ink jet recording apparatus 10 of FIG. 1.

<Modification Example>

Figure 12:
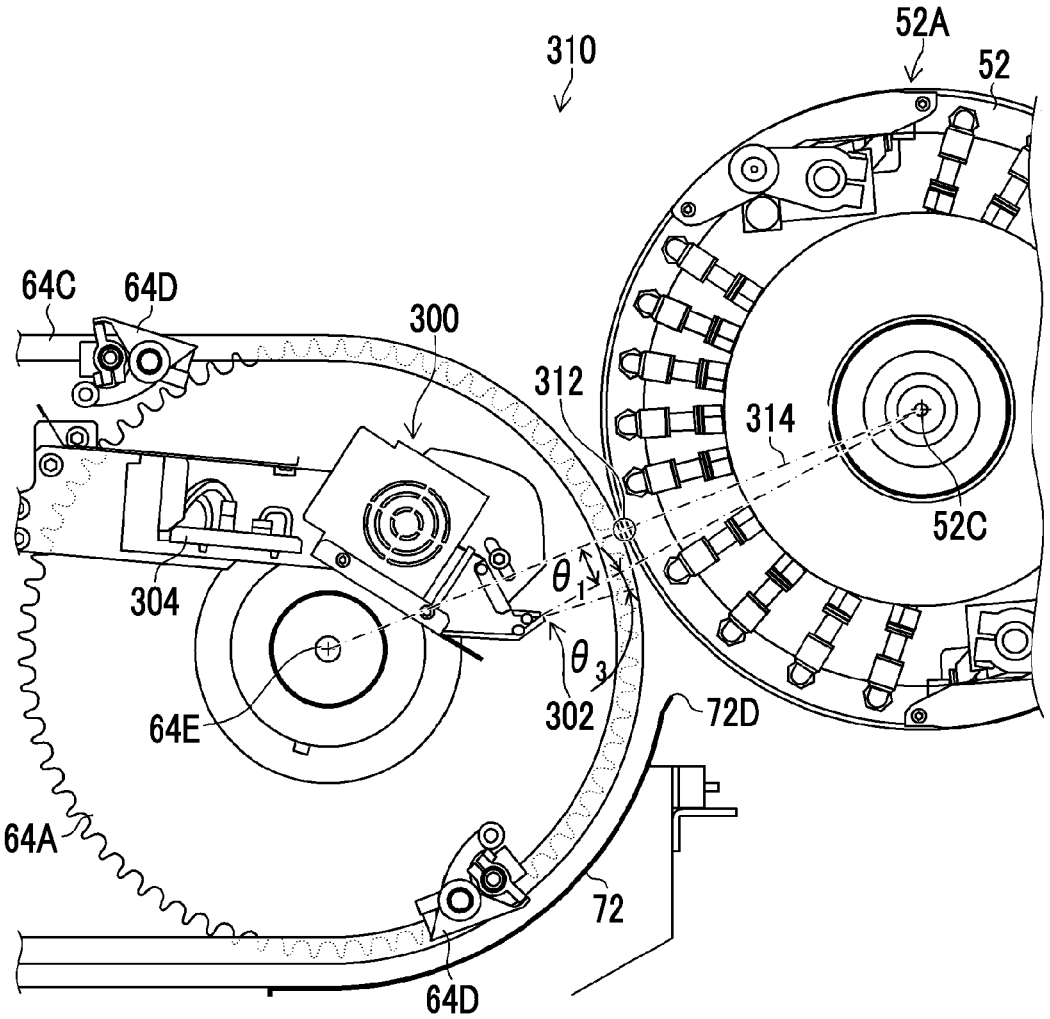
FIG. 12 is an explanatory view of a modification example of the conveyance device according to the embodiment of the present invention.

FIG. 12 is an explanatory view of a modification example of the conveyance device 310 described using FIGS. 8 to 11. In addition, in FIG. 12, the same reference numerals are assigned to the same portions as those of FIGS. 8 to 10 or the portions similar to those of FIGS. 8 to 10, and descriptions thereof are omitted.

In a conveyance device 310 shown in FIG. 12, a blowing direction (blowing angle) of the nozzle 302 of the blower unit 300 may be adjusted. That is, the blowing direction of the nozzle 302 toward the rotation center 52C of the image-forming drum 52 can be adjusted within a range of a downward angle $\theta_3$ (an adjustment unit).

In order to adjust the blowing direction of the nozzle 302, an inclination of the entire blower unit 300 may be changed, or an inclination of only the nozzle 302 may be changed.

In order to allow the conveyance route of the sheet P to follow (deform) the S shape, it is considered that wind blowing to the center of the sheet P is effective.

However, if a portion of the intermediate portion $P_2$ of the sheet P exceeds the path center line 314 and a force is applied in a direction separated from the outer circumferential surface of the image-forming drum 52 on the upstream side of the path center line 314 (transfer position 312) of the sheet P in the sheet conveyance direction, a force is applied to the sheet P so as to cause the sheet P to slide toward the rear side due to the stiffness of the sheet P, lifting of the intermediate portion $P_2$ occurs before the sheet P reaches the blowing position of the blower unit 300, and separation of the trailing end $P_3$ occurs.

Even when wind blows to the intermediate portion $P_2$ of the sheet P in which the separation of the trailing end $P_3$ occurs, it is confirmed that the sheet P is not returned to a normal conveyance path. Accordingly, in order to optimize the blowing position of wind, the blowing direction of the nozzle 302 may be adjusted.

In addition, when the ink-jet heads 56C, 56M, 56Y, and 56K (refer to FIG. 1) are close to the transfer position 312 or the trailing end $P_3$ of the preceding sheet P is fluttered due to wind which flows to the downstream side in the sheet conveyance direction from the blowing position, in order to decrease the influence of the wind, the volume of air flowing to the upstream side of the blowing position in the sheet conveyance direction and the volume of air flowing to the downstream side of the blowing position in the sheet conveyance direction may be adjusted by adjusting the blowing direction of the nozzle 302 downward.

In FIG. 12, the aspect in which the blowing direction of the nozzle 302 is adjusted downward is shown. However, by adjusting the blowing direction of the nozzle 302 upward, the blowing direction of the nozzle 302 is adjusted upward when flapping of the trailing end $P_3$ of the sheet P is suppressed.

A relationship between the kind (differences of thicknesses or like) of the sheet and the blowing direction (angle) of the nozzle 302 is obtained by experimentation, simulation, or the like and is stored, and the blowing direction of the nozzle 302 may be adjusted according to the kind of the sheet P.

By setting the blowing position of the nozzle 302 to the upstream side of one end 72D of the guide plate 72 (a guidance unit) in the sheet conveyance direction, the occurrence of the flow of the wind along the guide plate 72 can be prevented, and fluttering of the trailing end $P_3$ of the preceding sheet P is prevented.

[Description of Effect]

Figure 13:
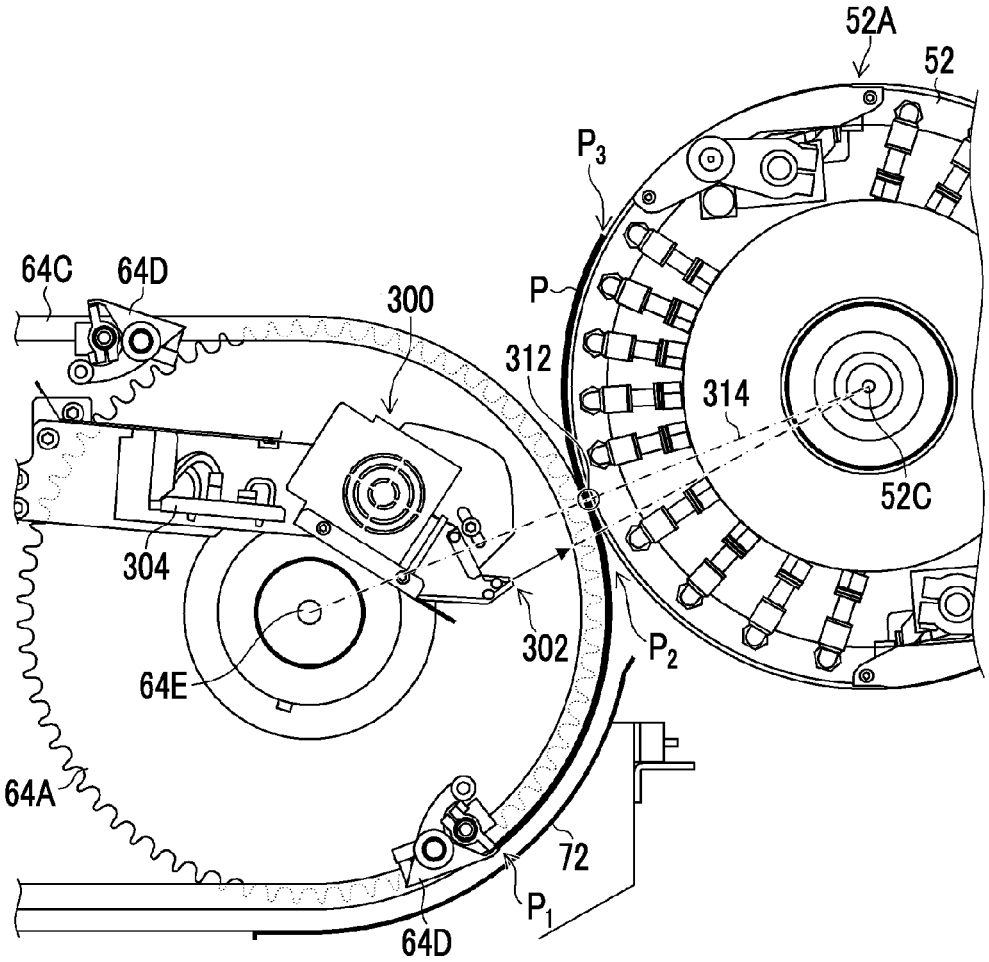
FIG. 13 is an explanatory view of effects of the conveyance device according to the embodiment of the present invention.

FIG. 13 is an explanatory view of effects according to the conveyance device and the conveyance method shown in the present example. The sheet P shown in FIG. 13 is conveyed along the path shown by the two-dot chain line in FIG. 7. That is, since wind blows from the blower unit 300 disposed inside the path around the chain gripper 64 toward the rotation center (rotation axis) 52C of the image-forming drum 52, the intermediate portion $P_2$ of the sheet P follows (is deformed along) the conveyance path of the chain gripper 64, and separation of the trailing end $P_3$ of the sheet P from the outer circumferential surface of the image-forming drum 52 is prevented due to stiffness of the sheet P.

Since wind is not blown to the guide plate 72, the wind which flows from the blowing position of the wind to the downstream side and the upstream side in the sheet conveyance direction decreases, and the separation of the leading end $P_1$ of the sheet P and the flapping of the trailing end $P_3$ are prevented.

Since wind blows to the portion immediately after the position (the separation position of the sheet P) at which the adsorption of the sheet P with respect to the image-forming drum 52 stops, the intermediate separation of the sheet P does not occur, and the separation of the trailing end $P_3$ is prevented. Particularly, the effects are effective when a thick sheet is used.

Since the separation of the trailing end $P_3$ of the sheet P is prevented, the contact of the trailing end $P_3$ of the sheet P discharged from the ink ejection regions of the ink-jet heads 56C, 56M, 56Y, and 56K with respect to the nozzle surfaces of the ink-jet heads 56C, 56M, 56Y, and 56K is prevented, and reliability and durability of the ink-jet heads 56C, 56M, 56Y, and 56K are improved.

It is possible to prevent the separation of the trailing end $P_3$ of the sheet P without complicating (while simplifying) the adsorption structure and the adsorption control of the sheet P in the image-forming drum 52.

Since the air volume is adjusted according to at least one of the thickness and the stiffness of the sheet P, it is possible to prevent winding and flapping of the trailing end $P_3$ of the preceding sheet P, and reliability of the drying processing applied to the sheet P conveyed by the chain gripper 64 is improved.

In the present example, the aspect is exemplified, in which the impression cylinder is applied to the sheet conveyance unit on the upstream side in the sheet conveyance direction and the chain gripper is applied to the sheet conveyance unit on the downstream side in the sheet conveyance direction. However, the sheet conveyance unit on the upstream side in the sheet conveyance direction may be a sheet conveyance unit that conveys the sheet P while holding (fixing) the rear surface of the sheet P. In addition, the sheet conveyance unit on the downstream side in the sheet conveyance direction may be a sheet conveyance unit that conveys the sheet without holding (fixing) the rear surface (or the surface) of the sheet P.

A belt conveyor which holds (fixes) the rear surface of the sheet P, or the like may be applied to the conveyance unit on the upstream side in the sheet conveyance direction, and a transfer cylinder (a barrel having a cylindrical frame structure) which fixes (hold) only the leading end of the sheet P and does not fix the rear surface (surface), a belt conveyor, or the like may be applied to the conveyance unit on the downstream side in the sheet conveyance direction.

In the present specification, the conveyance device in the ink jet recording apparatus is exemplified. However, the present invention may be widely applied to a conveyance device which conveys a sheet medium.

The conveyance device, the image-forming device, and the medium conveyance method described above may be appropriately modified, added, and removed within the scope which does not depart from the gist of the present invention. In addition, the above-described configuration examples may be appropriately combined.

[Invention Disclosed in the Present Specification]

As understood from descriptions with respect to the above-described embodiment of the invention, the present specification includes various disclosures of technical ideas including at least the following inventions.

(First Aspect): A conveyance device, comprises: a first conveyance unit that conveys a medium while fixing a first surface of the medium, configured to convey the medium along an arc-shaped path at a transfer position at which the medium is transferred to the downstream side in a conveyance direction in which the medium is conveyed; a second conveyance unit that is disposed on the downstream side of the first conveyance unit in the conveyance direction and includes a holding unit holding a leading end portion of the medium transferred from the first conveyance unit at the transfer position, configured to convey the medium transferred at the transfer position along the arc-shaped path on condition that a portion of the path is disposed at a position at which the portion of the path leads to the first conveyance unit side from the transfer position; and a blowing unit that is disposed on the second conveyance unit side from the transfer position and blows air from the second conveyance unit side to the first conveyance unit side on the downstream side of the transfer position in the conveyance direction, configured to blow air toward the medium conveyed by the second conveyance unit.

According to the first aspect, in the conveyance device in which the first conveyance unit and the second conveyance unit convey the medium along the arc-shaped path at the position at which the medium is transferred from the first conveyance unit to the second conveyance unit, and which includes the conveyance path in which the conveyance path of the second conveyance unit leads to the first conveyance unit side, air is blown from the second conveyance unit side to the first conveyance unit side with respect to the medium which is transferred from the first conveyance unit to the second conveyance unit. Accordingly, since the medium is conveyed along the arc-shaped path of the second conveyance unit, separation of a trailing end portion of the medium due to lifting of an intermediate portion of the medium is prevented.

As the first conveyance unit, a conveyance drum (conveyance barrel), which suctions and holds the first surface of the medium on an outer circumferential surface of the conveyance drum so as to rotate and convey the medium, may be applied.

(Second Aspect): In the conveyance device according to the first aspect, the second conveyance unit may be a drum having a cylindrical frame structure or be a chain gripper having a structure in which a chain is wound around a circular rotary member.

In the second aspect, since the first surface or the second surface (the surface opposite to the first surface) of the medium is not fixed to a general transfer cylinder and a general chain gripper, the medium is easily deviated from the conveyance route (conveyance path). In a case like that the transfer cylinder and the chain gripper are also applied as the second conveyance unit, the medium is not easily deviated from the conveyance path of the second conveyance unit, intermediate separation of the medium is prevented, and separation of the trailing end of the medium is prevented.

The chain gripper may include a linear conveyance path on the downstream side in the medium conveyance direction of the arc-shaped path.

(Third Aspect): In the conveyance device according to the first or second aspect, the blowing unit may blow air to the downstream side in the conveyance direction at a range within 15°, based on a line which connects a rotation center of the first conveyance unit and a rotation center of the second conveyance unit.

According to the third aspect, since air is blown to the downstream side in the medium conveyance direction from the transfer position at which the medium is transferred from the first conveyance unit to the second conveyance unit, blown air of the first conveyance unit along the arc-shaped path is prevented, and separation of the fixing of the medium conveyed by the first conveyance unit is prevented.

(Fourth Aspect): In the conveyance device according to any one of the first aspect to the third aspect, the conveyance device may further include an adjustment unit that adjusts a blowing direction of the blowing unit.

According to the fourth aspect, by adjusting the blowing direction of the blowing unit, it is possible to adjust flow of air toward the upstream side of the blowing position in the medium conveyance direction, and flow of air toward the downstream in the medium conveyance direction.

(Fifth Aspect): In the conveyance device according to any one of the first aspect to the fourth aspect, the second conveyance unit may include a guidance unit that guides the medium, and the blowing unit may blow air to the upstream side of the guidance unit in the conveyance direction.

According to the fifth aspect, air blown along the guidance unit is prevented, and flapping of the medium conveyed by the second conveyance unit is prevented.

(Sixth Aspect): In the conveyance device according to any one of the first aspect to the fifth aspect, the conveyance device may further include a medium information acquisition unit that acquires information of the medium including at least one of a thickness and stiffness of the medium, and a blowing control unit that controls an operation of the blowing unit, the blowing control unit may relatively decrease an amount of air blown from the blowing unit with respect to a medium having a relatively thin thickness and may relatively increase an amount of air blown from the blowing unit with respect to a medium having a relatively thick thickness, according to the acquired information of the medium.

According to the sixth aspect, it is possible to adjust the amount of air blown according to the thickness of the medium, flapping or separation of the medium due to an excessive amount of the air blown is prevented, and separation due to insufficient deformation of the medium which is generated due to an insufficient amount of the air blown is prevented.

(Seventh Aspect): In the conveyance device according to the sixth aspect, the blowing control unit may relatively decrease an amount of air blown from the blowing unit with respect to a medium having relatively low stiffness and may relatively increase an amount of air blown from the blowing unit with respect to a medium having a relatively high stiffness, according to the acquired information of the medium.

According to the seventh aspect, it is possible to adjust the amount of blown air according to the stiffness of the medium, flapping or separation of the medium due to an excessive amount of the blown air is prevented, and separation due to insufficient deformation of the medium which is generated due to an insufficient amount of the blown air is prevented.

(Eighth Aspect): In the conveyance device according to the sixth aspect or the seventh aspect, the blowing unit may include one or more blowers, and the blowing control unit may change the amount of the blown air by changing a rotating speed of the blower.

According to the eighth aspect, it is possible to adjust the amount of the blown air of the blowing unit by the adjustment of the amount of the blown air of the blower.

(Ninth Aspect): In the conveyance device according to the sixth aspect or the seventh aspect, the blowing unit may include two or more blowers, and the blowing control unit may change the amount of the blown air by changing the number of the operated blowers.

According to the ninth aspect, it is possible to adjust the amount of the blown air of the blowing unit by the adjustment of the number of the operated blowers.

(Tenth Aspect): In the conveyance device according to any one of the first aspect to the ninth aspect, on condition that a distance between the rotation center of the first conveyance unit and the rotation center of the second conveyance unit in a horizontal direction is defined as $L_2$, a rotation radius of the first conveyance unit is defined as $R_1$, and a rotation radius of the second conveyance unit is defined as $R_2$, a relationship of $L_2<R_1+R_2$ may be satisfied.

In an S-shaped conveyance in which the arc-shaped path of the second conveyance unit leads to the arc-shaped path side of the first conveyance unit, effects of the present invention are exhibited.

(Eleventh Aspect): In the conveyance device according to any one of the first aspect to the tenth aspect, on condition that a distance between the rotation center of the first conveyance unit and the rotation center of the second conveyance unit in a vertical direction is defined as $L_1$, $L_1>0$ may be satisfied.

In the S-shaped conveyance, the first conveyance unit and the second conveyance may be disposed so as to be shifted vertically.

(Twelfth Aspect): An image-forming device, comprises: a first conveyance unit that conveys a medium while fixing a first surface of the medium, configured to convey the medium along an arc-shaped path at a transfer position at which the medium is transferred to the downstream side in a conveyance direction in which the medium is conveyed; an image-forming unit that forms an image to the medium which is conveyed by the first conveyance unit; a second conveyance unit that is disposed on the downstream side of the first conveyance unit in the conveyance direction includes a holding unit holding a leading end portion of the medium transferred from the first conveyance unit at the transfer position, configured to convey the medium transferred at the transfer position along the arc-shaped path on condition that a portion of the path being disposed at a position at which the portion of the path leads to the first conveyance unit side from the transfer position; and a blowing unit that is disposed on the second conveyance unit side from the transfer position and blows air from the second conveyance unit side to the first conveyance unit side on the downstream side of the transfer position in the conveyance direction, configured to blow air toward the medium conveyed by the second conveyance unit.

In the twelfth aspect, preferably, the aspect includes the conveyance device according to any one of the second aspect to the eleventh aspect.

(Thirteenth Aspect): A medium conveyance method, includes: a first conveyance process of conveying a medium while fixing a first surface of the medium, and conveying the medium along an arc-shaped path at a transfer position at which the medium is transferred to the downstream side in a conveyance direction in which the medium is conveyed; a second conveyance process of holding a leading end portion of the medium transferred from the first conveyance unit at the transfer position, conveying the medium along the arc-shaped path, and having the path in which a portion of the path leads to the conveyance path side of the first conveyance process from the transfer position; and a blowing process of blowing air from a side to which the second conveyance process is applied to a side to which the first conveyance process is applied on the downstream side of the transfer position in the conveyance direction, and blowing air toward the medium conveyed by the second conveyance process.

In the thirteenth aspect, there may be provided an aspect including a drying unit that performs drying processing on the medium conveyed by the second conveyance unit.

In the thirteenth aspect, preferably, the aspect includes processes corresponding to the unit according to the second aspect to the eleventh aspect.

EXPLANATION OF REFERENCES

10: ink jet recording apparatus,

18: image-forming portion,

52: image-forming drum,
64: chain gripper,
64C: chain,
64D: gripper,
100: system controller,
126: blower control unit,
134: sheet information acquisition unit,
300: blower unit,
310: conveyance device,
320: blower

What is claimed is:

1. A conveyance device, comprising:

a first conveyance unit that conveys a medium while fixing a first surface of the medium, configured to convey the medium along an arc-shaped path at a transfer position at which the medium is transferred to the downstream side in a conveyance direction in which the medium is conveyed;

a second conveyance unit that is disposed on the downstream side of the first conveyance unit in the conveyance direction and includes a holding unit holding a leading end portion of the medium transferred from the first conveyance unit at the transfer position, configured to convey the medium transferred at the transfer position along the arc-shaped path on condition that a portion of the path is disposed at a position at which the portion of the path leads to the first conveyance unit side from the transfer position;

a blowing unit that is disposed on the second conveyance unit side from the transfer position and blows air from the second conveyance unit side to the first conveyance unit side on the downstream side of the transfer position in the conveyance direction, configured to blow air toward the medium conveyed by the second conveyance unit; and wherein the blowing unit blows air to the downstream side in the conveyance direction at a range within 15°, based on a line which connects a rotation center of the first conveyance unit and a rotation center of the second conveyance unit, the conveyance device further including:

a medium information acquisition unit that acquires information of the medium including at least one of a thickness and stiffness of the medium; and a blowing control unit that controls an operation of the blowing unit, wherein the blowing control unit relatively decreases an amount of air blown from the blowing unit with respect to a medium having a relatively thin thickness and relatively increases an amount of air blown from the blowing unit with respect to a medium having a relatively thick thickness, according to the acquired information of the medium, and wherein the blowing control unit relatively decreases an amount of air blown from the blowing unit with respect to a medium having relatively low stiffness and relatively increases an amount of air blown from the blowing unit with respect to a medium having a relatively high stiffness, according to the acquired information of the medium.

2. The conveyance device according to claim 1, wherein the second conveyance unit is a drum having a cylindrical frame structure or a chain gripper having a structure in which a chain is wound around a circular rotary member.

3. The conveyance device according to claim 2, further comprising, an adjustment unit that adjusts a blowing direction of the blowing unit.

4. The conveyance device according to claim 3, wherein the second conveyance unit includes a guidance unit that guides the medium, and wherein the blowing unit blows air to the upstream side of the guidance unit in the conveyance direction.

5. The conveyance device according to claim 2, wherein the second conveyance unit includes a guidance unit that guides the medium, and wherein the blowing unit blows air to the upstream side of the guidance unit in the conveyance direction.

6. The conveyance device according to claim 1, further comprising, an adjustment unit that adjusts a blowing direction of the blowing unit.

7. The conveyance device according to claim 6, wherein the second conveyance unit includes a guidance unit that guides the medium, and wherein the blowing unit blows air to the upstream side of the guidance unit in the conveyance direction.

8. The conveyance device according to claim 1, wherein the second conveyance unit includes a guidance unit that guides the medium, and wherein the blowing unit blows air to the upstream side of the guidance unit in the conveyance direction.

9. The conveyance device according to claim 1, wherein on condition that a distance between the rotation center of the first conveyance unit and the rotation center of the second conveyance unit in a horizontal direction is defined as $L_2$, a rotation radius of the first conveyance unit is defined as $R_1$, and a rotation radius of the second conveyance unit is defined as $R_2$, a relationship of $L_2<R_1+R_2$ is satisfied.

10. The conveyance device according to claim 1, wherein on condition that a distance between the rotation center of the first conveyance unit and the rotation center of the second conveyance unit in a vertical direction is defined as $L_1$, $L_1>0$ is satisfied.

11. A conveyance device, comprising:

a first conveyance unit that conveys a medium while fixing a first surface of the medium, configured to convey the medium along an arc-shaped path at a transfer position at which the medium is transferred to the downstream side in a conveyance direction in which the medium is conveyed;

a second conveyance unit that is disposed on the downstream side of the first conveyance unit in the conveyance direction and includes a holding unit holding a leading end portion of the medium transferred from the first conveyance unit at the transfer position, configured to convey the medium transferred at the transfer position along the arc-shaped path on condition that a portion of the path is disposed at a position at which the portion of the path leads to the first conveyance unit side from the transfer position;

a blowing unit that is disposed on the second conveyance unit side from the transfer position and blows air from the second conveyance unit side to the first conveyance unit side on the downstream side of the transfer position in the conveyance direction, configured to blow air toward the medium conveyed by the second conveyance unit; and wherein the blowing unit blows air to the downstream side in the conveyance direction at a range within 15°, based on a line which connects a rotation center of the first conveyance unit and a rotation center of the second conveyance unit, the conveyance device further including:

a medium information acquisition unit that acquires information of the medium including at least one of a thickness and stiffness of the medium; and a blowing control unit that controls an operation of the blowing unit, wherein the blowing control unit relatively decreases an amount of air blown from the blowing unit with respect to a medium having a relatively thin thickness and relatively increases an amount of air blown from the blowing unit with respect to a medium having a relatively thick thickness, according to the acquired information of the medium, wherein the blowing unit includes one or more blowers, and wherein the blowing control unit changes the amount of the air blown by changing a rotating speed of the blower.

12. A conveyance device, comprising:

a first conveyance unit that conveys a medium while fixing a first surface of the medium, configured to convey the medium along an arc-shaped path at a transfer position at which the medium is transferred to the downstream side in a conveyance direction in which the medium is conveyed;

a second conveyance unit that is disposed on the downstream side of the first conveyance unit in the conveyance direction and includes a holding unit holding a leading end portion of the medium transferred from the first conveyance unit at the transfer position, configured to convey the medium transferred at the transfer position along the arc-shaped path on condition that a portion of the path is disposed at a position at which the portion of the path leads to the first conveyance unit side from the transfer position;

a blowing unit that is disposed on the second conveyance unit side from the transfer position and blows air from the second conveyance unit side to the first conveyance unit side on the downstream side of the transfer position in the conveyance direction, configured to blow air toward the medium conveyed by the second conveyance unit; and wherein the blowing unit blows air to the downstream side in the conveyance direction at a range within 15°, based on a line which connects a rotation center of the first conveyance unit and a rotation center of the second conveyance unit, the conveyance device further including:

a medium information acquisition unit that acquires information of the medium including at least one of a thickness and stiffness of the medium; and a blowing control unit that controls an operation of the blowing unit, wherein the blowing control unit relatively decreases an amount of air blown from the blowing unit with respect to a medium having a relatively thin thickness and relatively increases an amount of air blown from the blowing unit with respect to a medium having a relatively thick thickness, according to the acquired information of the medium, wherein the blowing unit includes two or more blowers, and wherein the blowing control unit changes the amount of the air blown by changing the number of the operated blowers.

13. An image-forming device, comprising:

a first conveyance unit that conveys a medium while fixing a first surface of the medium, configured to convey the medium along an arc-shaped path at a transfer position at which the medium is transferred to the downstream side in a conveyance direction in which the medium is conveyed;

an image-forming unit that forms an image to the medium which is conveyed by the first conveyance unit;

a second conveyance unit that is disposed on the downstream side of the first conveyance unit in the conveyance direction includes a holding unit holding a leading end portion of the medium transferred from the first conveyance unit at the transfer position, configured to convey the medium transferred at the transfer position along the arc-shaped path on condition that a portion of the path is disposed at a position at which the portion of the path leads to the first conveyance unit side from the transfer position;

a blowing unit that is disposed on the second conveyance unit side from the transfer position and blows air from the second conveyance unit side to the first conveyance unit side on the downstream side of the transfer position in the conveyance direction, configured to blow air toward the medium conveyed by the second conveyance unit; and wherein the blowing unit blows air to the downstream side in the conveyance direction at a range within 15°, based on a line which connects a rotation center of the first conveyance unit and a rotation center of the second conveyance unit, the image-forming device further including:

a medium information acquisition unit that acquires information of the medium including at least one of a thickness and stiffness of the medium; and a blowing control unit that controls an operation of the blowing unit, wherein the blowing control unit relatively decreases an amount of air blown from the blowing unit with respect to a medium having a relatively thin thickness and relatively increases an amount of air blown from the blowing unit with respect to a medium having a relatively thick thickness, according to the acquired information of the medium, and wherein the blowing control unit relatively decreases an amount of air blown from the blowing unit with respect to a medium having relatively low stiffness and relatively increases an amount of air blown from the blowing unit with respect to a medium having a relatively high stiffness, according to the acquired information of the medium.

14. A medium conveyance method used for the conveyance device according to claim 1, comprising:

a first conveyance process of conveying the medium while fixing a first surface of the medium, and conveying the medium along the arc-shaped path at the transfer position at which the medium is transferred to the downstream side in the conveyance direction in which the medium is conveyed;

a second conveyance process of holding the leading end portion of the medium transferred from the first conveyance process at the transfer position, conveying the medium along the arc-shaped path, and having the path in which the portion of the path leads to the conveyance path side of the first conveyance process from the transfer position;

a blowing process of blowing air from a side to which the second conveyance process is applied to the side to which the first conveyance process is applied on the downstream side of the transfer position in the conveyance direction, and blowing air toward the medium conveyed by the second conveyance process; and wherein the blowing process blows air to the downstream side in the conveyance direction at the range within 15°, based on the line which connects the center of the conveyance path side of the first conveyance process and the center of the conveyance path side of the second conveyance process, the medium conveyance method further including:

a medium information acquisition process of acquiring information of the medium including at least one of a thickness and stiffness of the medium; and a blowing control process of controlling an operation of the blowing process, wherein the blowing control process relatively decreases an amount of air blown by the blowing process with respect to a medium having a relatively thin thickness and relatively increases an amount of air blown by the blowing process with respect to a medium having a relatively thick thickness, according to the acquired information of the medium, and wherein the blowing control process relatively decreases an amount of air blown by the blowing process with respect to a medium having relatively low stiffness and relatively increases an amount of air blown by the blowing process with respect to a medium having a relatively high stiffness, according to the acquired information of the medium.

* * * * *